US010890149B2

(12) United States Patent
Imperato et al.

(10) Patent No.: US 10,890,149 B2
(45) Date of Patent: Jan. 12, 2021

(54) FUEL SUPPLY VALVE FOR A SLURRY FUEL INJECTOR VALVE

(71) Applicant: A.P. Møller—Mærsk A/S, Copenhagen K (DK)

(72) Inventors: Matteo Imperato, Copenhagen (DK); Tim Reeve, Copenhagen (DK)

(73) Assignee: A.P. Møller—Mærsk A/S, Copenhagen K (DK)

( * ) Notice: Subject to any disclaimer, the term of this patent is extended or adjusted under 35 U.S.C. 154(b) by 0 days.

(21) Appl. No.: 16/569,464

(22) Filed: Sep. 12, 2019

(65) Prior Publication Data

US 2020/0003132 A1 Jan. 2, 2020

Related U.S. Application Data

(63) Continuation of application No. PCT/EP2018/056278, filed on Mar. 13, 2018.

(30) Foreign Application Priority Data

Mar. 13, 2017 (GB) ..... 1703938.9
Nov. 28, 2017 (GB) ..... 1719716.1

(51) Int. Cl.
*F02M 57/02* (2006.01)
*F02D 19/04* (2006.01)
(Continued)

(52) U.S. Cl.
CPC ..... *F02M 57/02* (2013.01); *F02D 19/04* (2013.01); *F02D 19/0602* (2013.01);
(Continued)

(58) Field of Classification Search
CPC ..... F02M 57/02; F02M 61/10; F02M 43/02; F02D 19/0602; F02D 19/0657;
(Continued)

(56) References Cited

U.S. PATENT DOCUMENTS 3,398,936 A 8/1968 Delano
3,591,086 A 7/1971 Levin
(Continued)

FOREIGN PATENT DOCUMENTS

CA 1308976 C 10/1992
CN 2173311 Y 8/1994
(Continued)

OTHER PUBLICATIONS

United Kingdom Search and Examination report dated May 18, 2018 for UK Application No. 1719716.1.
(Continued)

*Primary Examiner* — Mahmoud Gimie
(74) *Attorney, Agent, or Firm* — EIP US LLP

(57) ABSTRACT

A fuel supply valve for a slurry fuel injector valve, the fuel supply valve comprising: a fuel inlet for fluid communication with a slurry fuel reservoir; a fuel outlet for fluid communication with a nozzle of the fuel injector valve; a pump chamber port for fluid communication with a pump chamber of the fuel injector valve; and a valve gate moveable between a first position, at which the fuel inlet is in fluid communication along a first slurry fuel flow path with the pump chamber port, and a second position, at which the fuel outlet is in fluid communication along a second slurry fuel flow path with the pump chamber port; wherein the valve gate is operable with a valve actuation liquid from an engine.

14 Claims, 9 Drawing Sheets

(51) Int. Cl.

| | |
|---|---|
| ***F02M 61/10*** | (2006.01) |
| ***F02M 51/06*** | (2006.01) |
| ***F02D 19/06*** | (2006.01) |
| *F02D 41/00* | (2006.01) |

(52) U.S. Cl.
CPC ..... *F02D 19/0657* (2013.01); *F02D 19/0668* (2013.01); *F02D 19/0684* (2013.01); *F02M 51/0671* (2013.01); *F02M 61/10* (2013.01); *F02D 41/0025* (2013.01)

(58) Field of Classification Search
CPC .. F02D 19/0668; F02D 19/0684; F02D 19/04; F02D 51/0271; F02D 41/0025
USPC ..... 123/304
See application file for complete search history.

(56) References Cited

U.S. PATENT DOCUMENTS

| | | | | |
|---|---|---|---|---|
| 3,950,147 | A | 4/1976 | Funk et al. | |
| 4,408,718 | A | 10/1983 | Wich | |
| 4,412,657 | A | 11/1983 | Mowbray | |
| 4,633,830 | A | 1/1987 | Oshima et al. | |
| 4,662,315 | A | 5/1987 | Sommer | |
| 4,782,794 | A * | 11/1988 | Hsu | F02D 19/04 123/23 |
| 4,862,837 | A | 9/1989 | Holmes | |
| 4,991,771 | A | 2/1991 | Porchet et al. | |
| 5,056,469 | A * | 10/1991 | Kimberley | F02D 19/04 123/23 |
| 5,193,575 | A * | 3/1993 | Do | G05D 16/187 137/509 |
| 5,282,570 | A | 2/1994 | Johnson et al. | |
| 6,213,093 | B1 * | 4/2001 | Yudanov | F02M 45/00 123/446 |
| 6,237,857 | B1 | 5/2001 | Ausman et al. | |
| 2003/0075153 | A1 | 4/2003 | Augustin et al. | |
| 2004/0025843 | A1 | 2/2004 | Magel | |
| 2008/0047527 | A1 | 2/2008 | Sun et al. | |
| 2012/0056018 | A1 | 3/2012 | Kobayashi | |
| 2013/0233946 | A1 | 9/2013 | Kobayashi | |
| 2014/0314603 | A1 | 10/2014 | Inoue et al. | |
| 2017/0051712 | A1 | 2/2017 | Sauvetre et al. | |

FOREIGN PATENT DOCUMENTS

| | | | |
|---|---|---|---|
| CN | 104791786 | A | 7/2015 |
| CN | 207761863 | U | 8/2018 |
| DE | 102007000159 | A1 | 9/2007 |
| EP | 0957262 | A2 | 11/1999 |
| EP | 1780401 | A1 | 5/2007 |
| EP | 1837515 | A1 | 9/2007 |
| EP | 1965070 | A1 | 9/2008 |
| EP | 2940287 | A | 11/2015 |
| EP | 3070321 | A1 | 9/2016 |
| EP | 3070322 | A1 | 9/2016 |
| GB | 473174 | A | 10/1937 |
| GB | 868093 | A | 5/1961 |
| JP | H06147057 | A | 5/1994 |
| JP | H07103106 | A | 4/1995 |
| JP | H0311264 | A | 11/1998 |
| JP | 2014227913 | A | 12/2014 |
| WO | 2004088122 | A1 | 10/2004 |
| WO | 2011162681 | A1 | 12/2011 |

OTHER PUBLICATIONS

United Kingdom Search and Examination report dated May 23, 2018 for UK Application No. 1719717.9.
United Kingdom Search and Examination report dated May 24, 2018 for UK Application No. 1719718.7.
International Search Report dated May 22, 2018 for PCT Application No. PCT/EP2018/056276.
International Search Report dated May 25, 2018 for PCT Application No. PCT/EP2018/056278.
International Search Report dated May 24, 2018 for PCT Application No. PCT/EP2018/056281.
International Search Report dated Jun. 5, 2018 for PCT Application No. PCT/EP2018/056283.
United States Office Action dated Jun. 2, 2020 for U.S. Appl. No. 16/569,511.
European Article 94(3) Examination report dated Oct. 2, 2020 for EP Application No. 18 714 981.0.
European Article 94(3) Examination report dated Oct. 6, 2020 for EP Application No. 18 714 978.6.

* cited by examiner

FUEL SUPPLY VALVE FOR A SLURRY FUEL INJECTOR VALVE

CROSS-REFERENCE TO RELATED APPLICATIONS

This application is a continuation of International Application No. PCT/EP2018/056278, filed Mar. 13, 2018, which claims priority to United Kingdom Application No. 1703938.9, filed Mar. 13, 2017 and United Kingdom Application No. 1719716.1 filed Nov. 28, 2017, under 35 U.S.C. § 119(a). Each of the above referenced patent applications is incorporated by reference in its entirety.

BACKGROUND OF THE INVENTION

Field of the Invention

The present invention relates to a fuel supply valve and fuel injector valve for an engine, and preferably a two-stroke marine engine. In particular, the present invention relates to a fuel supply valve and fuel injector valve for a non-Newtonian fuel such as a slurry fuel or an emulsion fuel.

Description of the Related Technology

Current injection technology within diesel engines employs oil based Newtonian fuels derived from liquid hydrocarbons. This may include, but is not limited to conventional diesel, marine diesel oil, marine gas oil and heavy fuel oil.

In order for the fuel to burn, the fuel needs to be pumped at high pressure into a chamber within the injector, also known as a fuel valve or fuel supply valve. Conventional fuel systems use a high-pressure pump and common rail technology to deliver high pressure fuel up to one thousand bar to the fuel injectors. A volume of fuel therefore is maintained at high pressure in conventional fuel systems. Conventional diesel engines employ pressure atomization of relatively low viscosity fuel with Newtonian properties.

For heavy fuel oils the fuel viscosity is controlled to 10-20 mPa·s by heating before it enters the engine's high pressure injection pumps. High pressure fuel is provided to the injection pumps at relatively high constant pressure by the feed pumps of the fuel system. In some conventional fuel systems a high-pressure pump and common rail technology is used to deliver high pressure fuel up to 1000 bar to the injectors. In other engines such as a marine common rail four-stroke engine the pressure can be as high as 1500 bar. A volume of fuel therefore is maintained at high pressure.

It is known to replace the heavy fuel oil with a slurry fuel or an emulsion fuel, which have significantly different properties compared to heavy fuel oils. The slurry fuel can be a carbonaceous aqueous slurry fuel. That is a suspension of carbon particles, such as coal or solidified bitumen, in water. An emulsion fuel can be an emulsion of liquid particles of hydrocarbon, such as bitumen, and water. The carbonaceous aqueous slurry fuels can have a higher viscosity, have a non-Newtonian rheology and are more difficult to atomise. The solid carbon particles of the carbonaceous aqueous slurry fuels can have a tendency to deposit when the slurry fuel is not flowing.

The combustion, transportation, storage and utilization of these carbonaceous aqueous slurry fuels may cause a number of technical problems. The carbonaceous solid particles forming the slurry can settle in tanks and fuel lines, and may block smaller orifices of the fuel injection equipment both during engine operation and when stopped.

Experiments have shown that slurry fuels can change characteristics in terms of stability and rheology across pressure differentials. In some cases slurry fuels react negatively when the slurry fuel is exposed to a high pressure for extended periods of time. For example the slurry fuels can behave adversely to high shear or cavitation conditions such as may be experienced through pressure relief valves and throttling valves. It has been observed that the particles may precipitate out of solution and/or particles may agglomerate at various positions in the fuel system. This means that conventional fuel injectors such as that shown in EP 3 070 322 may not work effectively or even at all with slurry fuels.

Known fuel injection systems using slurry fuels are disclosed in U.S. Pat. Nos. 4,782,794 and 5,056,469 where the slurry fuel is injected with a high pressure in the fuel injection system. A problem with the known fuel injection systems is that agglomeration and precipitation of the solid fuel component in the slurry fuel can occur anywhere in the fuel system. This degrades the susceptibility of atomisation of aqueous slurries. This can cause increased ignition delay and incomplete combustion and in turn can contribute to misfire of the engine, ring damage and reduction in engine longevity.

Embodiments of the present invention aim to address the aforementioned problems.

SUMMARY

According to a first aspect of the present invention there is provided a fuel supply valve for a slurry fuel injector valve, the fuel supply valve comprising: a fuel inlet for fluid communication with a slurry fuel reservoir; a fuel outlet for fluid communication with a nozzle of the fuel injector valve; a pump chamber port for fluid communication with a pump chamber of the fuel injector valve; and a valve gate moveable between a first position, at which the fuel inlet is in fluid communication along a first slurry fuel flow path with the pump chamber port, and a second position, at which the fuel outlet is in fluid communication along a second slurry fuel flow path with the pump chamber port; wherein the valve gate is operable with a valve actuation liquid from an engine.

As the slurry fuel need not be used to operate the valve gate, the pressure of the slurry fuel can be relatively low. This in turn helps to avoid agglomeration of solid particles from the slurry fuel in and near the fuel supply valve.

Optionally, the fuel supply valve comprises a valve actuation liquid chamber, wherein valve actuation liquid is receivable into the valve actuation liquid chamber to exert a force on the valve gate to drive the valve gate between the first and second positions.

Optionally, the valve actuation liquid is receivable into the valve actuation liquid chamber to exert a force on the valve gate to drive the valve gate towards the second position.

Optionally, the valve actuation liquid chamber is isolated from the pump chamber port.

Optionally, the fuel supply valve comprises a valve body and a valve bore, wherein the valve body includes the valve gate and is movable in the valve bore, and the valve body has at least one groove therein for receiving the valve actuation liquid between the valve body and the valve bore to lubricate movement of the valve body in the valve bore.

Optionally, the fuel supply valve comprises a control valve for controlling input of valve actuation liquid into the valve actuation liquid chamber.

Optionally, the control valve is electrically or electronically controllable.

Optionally, the control valve has a first port for fluid communication with the valve actuation liquid chamber, a second port for fluid communication with a source of valve actuation liquid, and a third port for fluid communication with a drain, and the control valve is for selecting which of the second and third ports is in fluid communication with the first port.

Optionally, the valve gate is linearly moveable between the first and second positions.

Optionally, the valve gate is slidably moveable between the first and second positions.

Optionally, the valve gate permits slurry fuel to flow from the fuel inlet to the pump chamber port when the valve gate is at the first position, and wherein the valve gate hinders or prevents slurry fuel flowing from the fuel inlet to the pump chamber port when the valve gate is at the second position.

Optionally, the pump chamber port is in fluid communication with the fuel outlet when the valve gate is at the first position and when the valve gate is at the second position.

Optionally, the valve gate is rotatable between the first position and the second position. Optionally, the valve gate comprises at least one pump chamber moveable between the first and second position. Optionally, the valve gate comprises a plurality of pump chambers, each of the pump chambers arranged to be sequentially rotatable into the first and/or second positions. Optionally, each pump chamber comprises a pump piston slidably mounted in the pump chamber and arranged to urge slurry fuel to the nozzle when the pump piston moves towards the pump chamber port. Optionally, each pump chamber is rotatably moveable to a third position wherein the pump chamber is aligned with a flushing fluid port.

According to a second aspect of the present invention there is provided a fuel supply valve for a slurry fuel injector valve, the fuel supply valve comprising: a fuel inlet for fluid communication with a slurry fuel reservoir; a fuel outlet for fluid communication with a nozzle of the fuel injector valve; a pump chamber port for fluid communication with a pump chamber of the fuel injector valve; and a valve gate moveable in a valve chamber between a first position, wherein the fuel inlet is in fluid communication along a first slurry fuel flow path with the pump chamber port, and a second position, wherein the fuel outlet is in fluid communication along a second slurry fuel flow path with the pump chamber port; wherein the valve gate is arranged to not substantially exert a force opposing a flow of the slurry fuel into the valve chamber when the valve gate moves between the second position and the first position and/or between the first position and the second position.

This means that the slurry fuel is not exposed to a high pressure in the fuel supply valve. Elsewhere in the fuel system the slurry fuel is handled at a lower pressure, and the slurry fuel is less likely to behave in unpredictable ways.

Preferably the pressure of the slurry fuel across the fuel supply valve is between 6 bar and 15 bar. This means that the slurry fuel is constantly at a low pressure.

Preferably the force for moving the valve gate between the first and second position and/or the second and first position is between 0 N and 100 N, or less than 100 N. By avoiding the slurry fuel having to work against e.g. a stiff spring in the fuel supply valve, the pressure of the slurry fuel can be lower. This avoids agglomeration of solid particles in and near the fuel supply valve.

Preferably the valve gate is rotatable between the first position and the second position. Preferably the valve gate comprises at least one pump chamber moveable between the first and second position. Preferably the valve gate comprises a plurality of pump chambers, each of the pump chambers arranged to be sequentially rotatable into the first and/or second positions. Preferably each pump chamber comprises a pump piston slidably mounted in the pump chamber and arranged to urge slurry fuel to the nozzle when the pump piston moves towards pump chamber port. Preferably each pump chamber is rotatably moveable to a third position wherein the pump chamber is aligned with a flushing fluid port. Preferably the valve gate is operable with a servo liquid from an engine of the fuel injector valve. The servo liquid is an example of a valve actuation liquid.

This means that the valve gate moves transversely with respect to the direction of the fluid flow. When the valve gate moves transversely with respect to the slurry flow, the forces exerted on the slurry fuel are minimised.

Preferably the valve gate is slidably moveable between the first and second positions. Preferably the valve gate comprises an inlet surface for engaging with a flow of slurry fuel from the fuel inlet and a chamber surface for engaging with slurry fuel in the pump chamber. Preferably the surface area of the chamber surface is greater than the surface area of the inlet surface.

Preferably the valve gate is coupled to a spring for biasing the valve gate to the second position.

The sliding valve gate uses the pressure of the slurry fuel itself. In this way the slurry fuel pressure does not have to be raised to actuate the fuel supply valve.

Preferably the fuel supply valve comprises a sealing liquid conduit adjacent to the moveable valve gate. This prevents hard-wearing particles of the slurry fuel wearing and damaging moveable parts of the fuel supply valve. The sealing liquid seals and lubricates the fuel supply valve.

According to a third aspect of the present invention there is provided a fuel injector valve for a slurry fuel, the fuel injector valve comprising: a nozzle via which slurry fuel is able to exit the injector valve towards a combustion chamber of an engine; a housing and a pump cavity within the housing; a pump element that divides the pump cavity into a pump chamber and an actuation chamber; and a fuel supply valve according to the first or second aspect of the present invention for selectively placing the pump chamber in fluid communication with the fuel inlet of the fuel supply valve.

Optionally, the pump element is fluid-actuatable. Optionally, the pump element comprises a shuttle piston. Optionally, the shuttle piston comprises a pump piston slidably mounted in the pump chamber and arranged to exert a force on the slurry fuel; and an actuation piston coupled to the pump piston and arranged to transmit a force to the pump piston.

Preferably the fuel injector valve comprises a sealing liquid reservoir in fluid communication with the moveable valve gate wherein the sealing liquid is arranged to seal the moveable valve gate against a valve housing. Preferably the sealing liquid reservoir is in fluid communication with the nozzle of the fuel injector valve, for mixing the sealing liquid with sealing liquid in the nozzle. Preferably the sealing liquid reservoir is in fluid communication with a needle valve seat in the nozzle.

BRIEF DESCRIPTION OF THE DRAWINGS

Embodiments of the invention will now be described, by way of example only, with reference to the accompanying drawings, in which.

DETAILED DESCRIPTION OF CERTAIN INVENTIVE EMBODIMENTS

Figure 1:
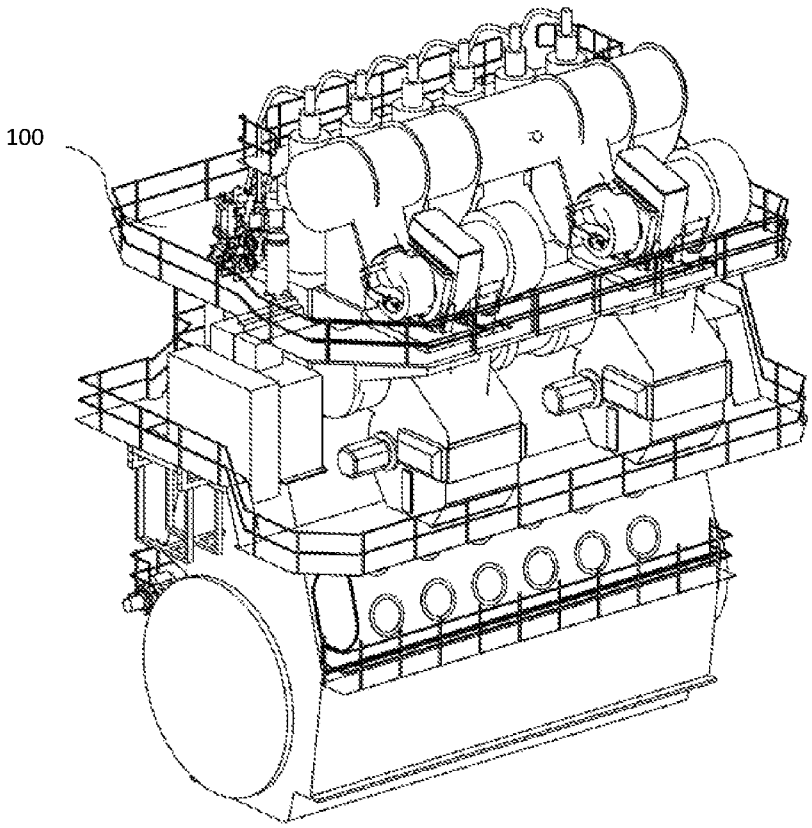
FIG. 1 shows a perspective view of an engine.

FIG. 1 shows a perspective view of an engine 100 comprising a fuel injector valve 102 and a fuel supply valve 122 discussed hereinafter. In some embodiments the engine 100 is a large low-speed turbocharged two-stroke diesel engine. In some embodiments the engine is a two-stroke marine engine. In other embodiments the engine 100 can be another type and/or size of engine. In the example shown in the embodiment of FIG. 1, the engine 100 has six cylinders in line. Large low-speed turbocharged two-stroke diesel engines have typically between four and fourteen cylinders in line, carried by an engine frame. The engine 100 in some embodiments may be used in conjunction with another identical engine. The engine 100 may be used as the main engine, or one of the main engines, in an ocean-going vessel. The engine 100 may be coupled to the propeller shaft of the vessel. Alternatively the engine may be a stationary engine for operating a generator in a power station. The total output of the engine may, for example, range from 1,000 to 110,000 kW.

In some embodiments, the engine 100 has one or more fuel injector valves 102. The engine 100 as shown in FIG. 1 has six fuel injector valves to correspond to the number of cylinders. Of course, the number of fuel injector valves will vary depending on the number of cylinders that are present in the engine 100. In alternative embodiments there are multiple fuel injector valves 102 per cylinder. Hereinafter for the purposes of clarity and conciseness, only one fuel injector valve 102 will be discussed with reference to the Figures.

In contrast to known fuel injectors, the fuel, such as heavy fuel oil or diesel, is replaced with a slurry fuel. The slurry fuel has different properties compared to heavy fuel oils or other oil-based hydrocarbon fuels.

In some embodiments, the slurry fuel can be a carbonaceous aqueous slurry fuel. In some embodiments the slurry fuel is a micronized refined carbon (MRC) fuel. Alternatively the slurry fuel may be referred to as a coal and water mixture (CWM). That is a suspension of carbon particles, such as coal or solidified bitumen, in water. In other embodiments the fuel can be an emulsion of liquid particles of hydrocarbon, such as bitumen, and water. In yet further embodiments the slurry fuel comprises a solid fuel particulate component in a liquid solution, or a liquid fuel droplet component in a different liquid component.

The carbonaceous aqueous slurry fuels can have a higher viscosity, have a non-Newtonian rheology and are more difficult to atomise. The solid carbon particles of the carbonaceous aqueous slurry fuels can have a tendency to deposit when the slurry fuel is not flowing. Hereinafter, for the purposes of brevity the term "slurry fuel" will incorporate a carbonaceous aqueous slurry fuel, other slurry fuels and emulsion fuels.

Figure 2:
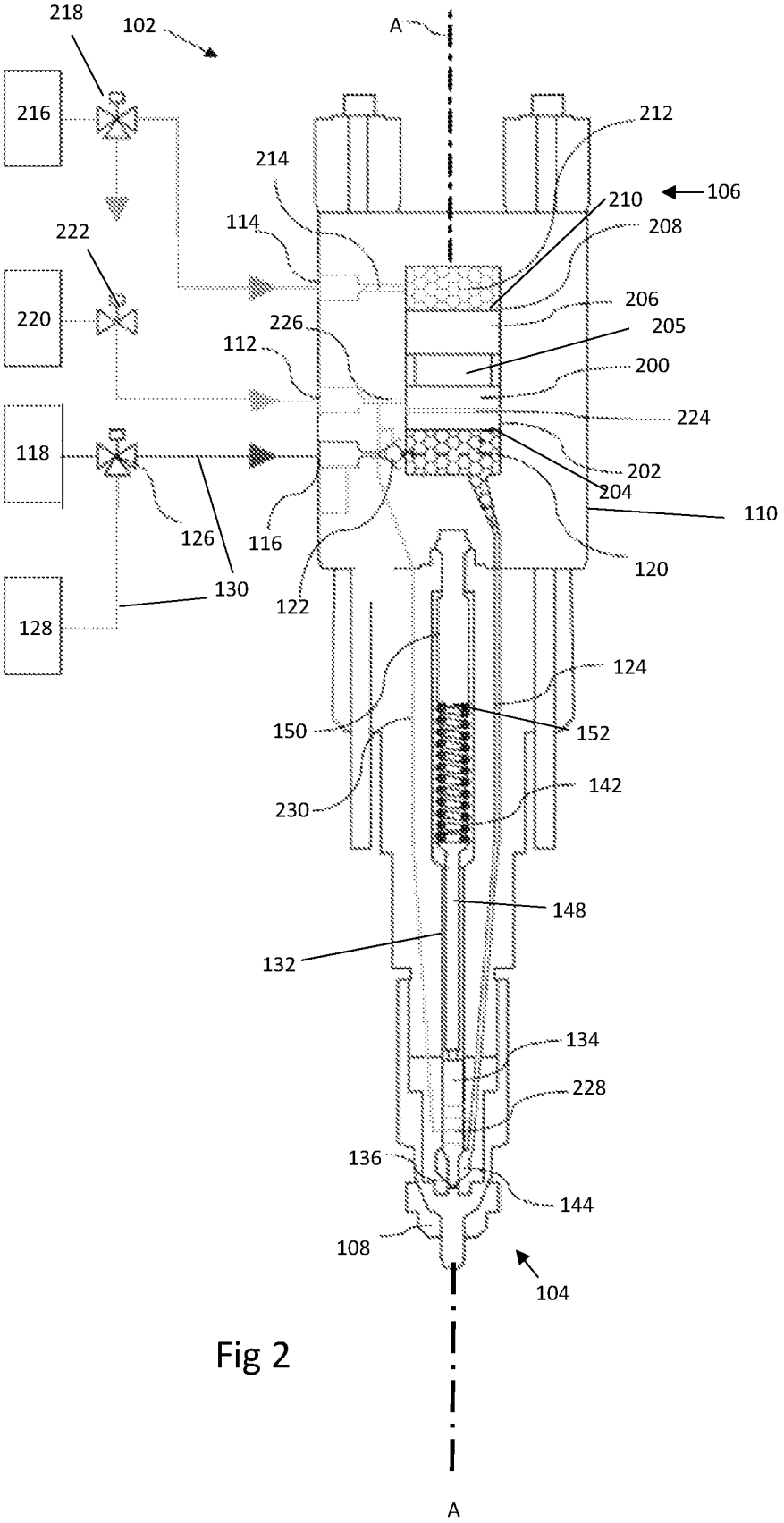
FIG. 2 shows a cross sectional schematic side view of a fuel injector valve according to an embodiment.

The fuel injector valve 102 will now be discussed in more detail with reference to FIG. 2. FIG. 2 shows a schematic cross sectional representation of the fuel injector valve 102. The fuel injector valve 102 is elongate and extends along a longitudinal axis A-A. The fuel injector valve 102 has a first end 104 and a second end 106. The fuel injector valve 102 is generally tapered in cross section from the second end 106 to the first end 104. The fuel injector valve 102 is generally cylindrical or conical in shape. The fuel injector valve 102 comprises a housing 110 for mounting the fuel injector valve 102 to the engine or other suitable structure proximal to the engine 100. The housing 110 surrounds and protects the internal parts of the fuel injector valve 102.

A nozzle 108 is mounted on the first end 104 of the fuel injector valve 102.

The housing 110 is provided with a sealing liquid inlet port 112 and an actuation liquid inlet port 114. The actuation liquid is for actuating the fuel injector valve 102 and urging the slurry fuel in the fuel injector valve 102 into a combustion chamber 300 (see for example FIG. 4) of the engine. The actuation liquid arrangement will be discussed in more detail below.

The sealing liquid is for lubricating and separating the slurry fuel from other parts of the fuel injector valve 102. The sealing liquid in some embodiments is sealing oil. The term sealing liquid will be used herein after to refer to a liquid that seals and lubricates parts of the fuel injector valve 102. The sealing liquid arrangement will be discussed in more detail below. In some embodiments the actuation liquid is also used for the sealing liquid and this will be discussed in further detail below with respect to the actuation liquid.

The housing 110 is provided with a fuel inlet port 116 for fluid communication with a first reservoir 118 of carbonaceous slurry fuel. The first reservoir 118 is a fuel tank which can be located remote from the fuel injector valve 102. The first reservoir 118 is in fluid communication with the fuel inlet port 116 by one or more fuel lines 130.

Optionally, the fuel inlet port 116 may connect to one or more sources of fuel, for example by means of a three-way valve 126, allowing the fuel injector valve 102 to switch between a primary source of fuel stored in the first reservoir 118 and a secondary source of fuel stored in a second reservoir 128. The second reservoir 128 is in fluid communication with the fuel inlet port 116 via the one or more fuel lines 130. The second reservoir 128 is also a fuel tank which can be located remote from the fuel injector valve 102.

The primary and secondary sources of fuel may comprise different sources of fuel. In some embodiments the first reservoir 118 comprises a slurry fuel and the second reservoir 128 comprises a different fuel, such as a non-slurry fuel such as a low sulphur hydrocarbon fuel system where the sulphur content is less than 0.1%, for example marine diesel oil (MDO). Alternative fuels, such as a heavy fuel oil (HFO) fuel system, can be used. Alternatively the second reservoir 128 comprises the same type of fuel as the first reservoir 118.

The fuel from the first and the second reservoir 118, 128 is pumped to the fuel inlet port 116 by one or more fuel pumps (not shown). The fuel pump pressurises the fuel in the first and second reservoirs 118, 128 and drives the fuel from the first and second reservoirs 118, 128 to the fuel injector valve 102. The different fuels may be pressurised at different pressures.

The second fuel reservoir 128 is not necessary, but provides additional resilience to the fuel system in case the engine 100 is required to burn a different type of fuel with different characteristics. For example the engine 100 can be switched from burning a slurry fuel to another type of fuel to reduce emissions in certain geographical areas or to flush the slurry fuel from the fuel system.

The fuel injector valve 102 may be operated using a fuel different from a slurry fuel prior to shut down of the engine 100 in order to flush the fuel injector valve 102. This means a fuel such as HDO or MDO, which do not contain carbonaceous solid particles, can be used to flush the fuel pipes and other parts of the fuel system free from carbonaceous particles. In this way periodic maintenance of the fuel injector valve 102 can be carried out and deposition of particulates can be reduced and/or eliminated. However, once large amounts of the MRC fuel become solid, the MRC fuel may not flow, and it can be difficult to remove from the injector channels by flushing.

The fuel inlet port 116 connects to a pump chamber 120 in the valve housing 110 via a fuel supply valve 122. The fuel supply valve 122 will be discussed in further detail below. The pump chamber 120 is in fluid communication with the nozzle 108 via a nozzle fuel conduit 124. In some embodiments, the nozzle fuel conduit 124 bypasses the fuel supply valve 122, so that fuel can flow from the pump chamber 120 to the nozzle 108 without passing through the fuel supply valve 122. In other embodiments, the nozzle fuel conduit may extend to the nozzle 108 from the fuel supply valve 122, so that fuel can flow from the pump chamber 120 to the nozzle 108 via the fuel supply valve 122. The nozzle fuel conduit 124 extends longitudinally along the axis A-A. In some embodiments the nozzle fuel conduit 124 may comprise a plurality of nozzle fuel conduits 124 (not shown). A plurality of fuel nozzle conduits 124 is used to increase the flow rate of slurry fuel delivered to the nozzle 108. In some embodiments there are two nozzle fuel conduits 124 in fluid communication between the pump chamber 120 and the nozzle 108. This means that a slurry fuel that may have a lower fuel energy density can be provided in higher volumes at the nozzle 108.

Figure 3:
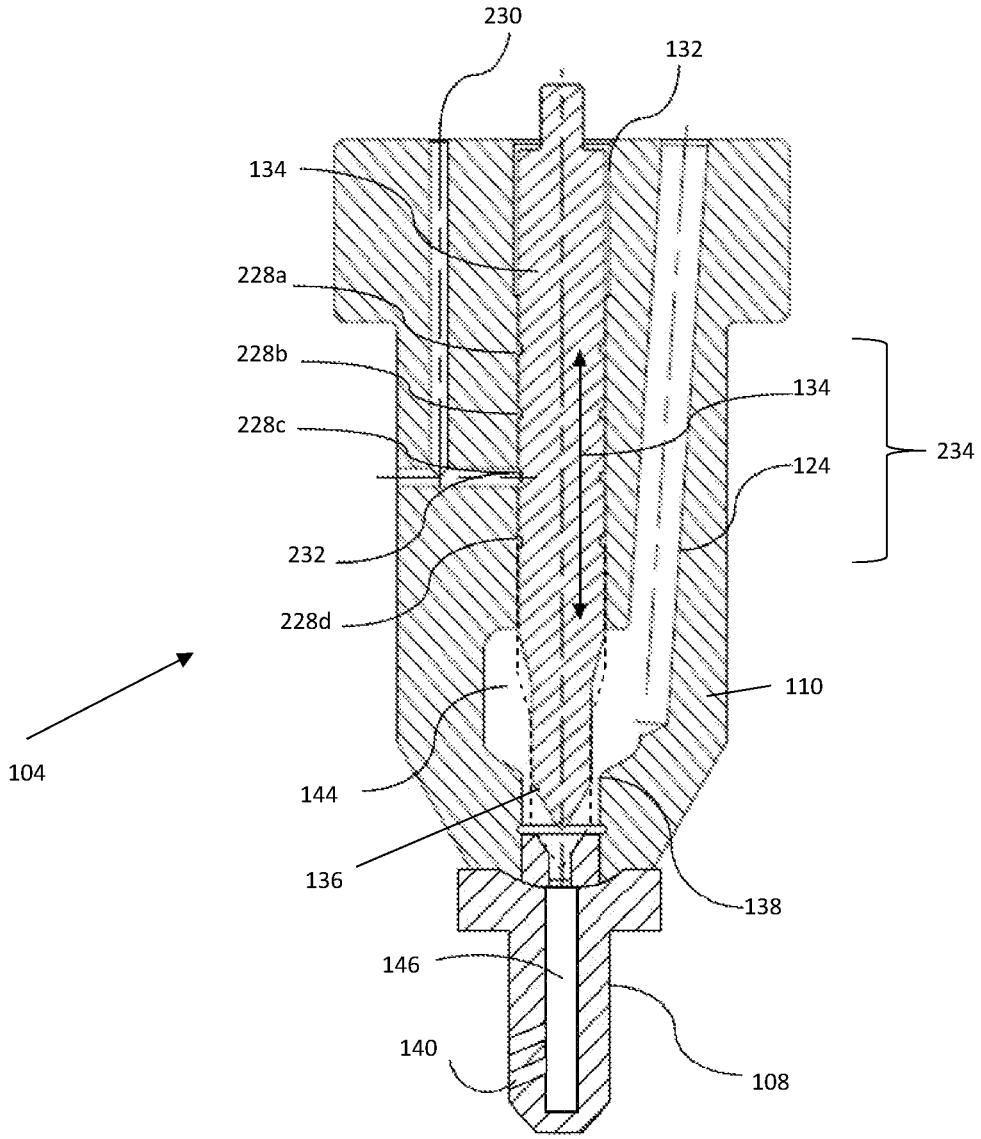
FIG. 3 shows a partial cross sectional side view of a nozzle of a fuel injector valve according to an embodiment.

The fuel nozzle 108 will now be discussed in more detail with respect to FIG. 3. FIG. 3 shows a cross sectional side view of the tip of the fuel injector valve 102. As mentioned above, the nozzle 108 is mounted at the first end 104 of the housing 110 of the fuel injector valve 102.

In some embodiments the nozzle 108 is a separate element that is mounted to the first end 104 of the housing 110. In other embodiments, the nozzle 108 is integral with the housing 110. The nozzle 108 has one or more fuel outlet holes 140. The fuel outlet hole may be axially aligned with the axis A-A. Alternatively or additionally the nozzle 108 comprises a plurality of nozzle bores (not shown) that are radially and/or axially distributed over the nozzle 108.

The housing 110 of the fuel injector valve 102 comprises a longitudinal bore 132. The longitudinal bore 132 extends from the first end 104 of the fuel injector valve 102 towards the second end 106. The longitudinal bore 132 is axially aligned with the axis A-A.

A moveable valve needle 134 is mounted within the longitudinal bore 132. In some embodiments the moveable valve needle 134 is slidably received in the longitudinal bore 132. The moveable valve needle 134 is moveable between a closed position and an open position along the longitudinal axis A-A and a longitudinal axis of the moveable valve needle 134. The direction of movement of the moveable valve needle 134 is shown by the two-headed arrow in FIG. 3. FIG. 3 shows the moveable valve needle 134 in the open position. A ghosted representation of the moveable valve needle 134 in the closed position is shown by a dotted line in FIG. 3.

In the closed position, a tip 136 of the moveable valve needle 134 abuts against a needle valve seat 138. That is, in the closed position, the valve needle 134 rests on the needle valve seat 138. The moveable valve needle 134 is biased towards the closed position by a spring 142 (shown in FIG. 2). A needle fuel chamber 144 surrounds the tip 136 of the moveable valve needle 134.

The needle fuel chamber 144 is in fluid communication with the nozzle fuel conduit 124. When the moveable valve needle 134 is in the open position, the needle fuel chamber 144 is in fluid communication with a longitudinal nozzle bore 146. The longitudinal nozzle bore 146 is axially aligned with the longitudinal axis A-A and the longitudinal bore 132. This means that the slurry fuel can flow from the needle fuel chamber 144 to the longitudinal bore 146 when the moveable valve needle 134 is in the open position.

In contrast, when the moveable valve needle 134 is in the closed position, the needle tip 136 is sealed against the needle valve seat 138 and the needle fuel chamber 144 is sealed off from the longitudinal nozzle bore 146. Accordingly when the moveable valve needle 134 is in the closed position, the slurry fuel cannot flow from the nozzle fuel conduit 124 and the needle fuel chamber 144 to the longitudinal nozzle bore 146.

Turning back to FIG. 2, the moveable valve needle 134 is coupled to a needle piston 148. The spring 142 is mounted in a spring chamber 150 between the needle piston 148 and a spring shoulder portion 152. The spring 142 is a coil spring and urges the needle piston 148 and the moveable valve needle 134 toward the first end 104 and the closed position. In other embodiments the spring 142 can be other types of spring or any suitable means for urging the moveable valve needle 134 towards the closed position.

The actuation liquid arrangement will now be discussed in further detail. A fuel injection piston 200 is provided in a first bore 202. The fuel injection piston 200 is substantially cylindrical and the first bore 202 is reciprocally shaped. The fuel injection piston 200 and the first bore 202 are axially aligned with axis A-A. The fuel injection piston 200 is moveable within the first bore 202. The fuel injection piston is axially slidable within the first bore 202. A lower surface 204 of fuel injection piston 200 is adjacent to and in contact with the slurry fuel in the pump chamber 120. The fuel injection piston 200 is arranged to move within the first bore 202 and urge the slurry fuel towards the nozzle 108 via the nozzle fuel conduit 124. The functionality of the fuel injection piston 200 will be discussed in more detail further below.

The fuel injection piston 200 is coupled to an actuation piston 206 that is located within a second bore 208. The fuel injection piston 200 and actuation piston 206 as shown in FIG. 2 are part of the same shuttle piston 205. The shuttle piston 205 is a single integral element that slidably moves within first and second bores 202, 208.

In some embodiments the actuation piston 206 is provided in the second bore 208. In some embodiments the first bore 202 and the second bore 208 are the same. The actuation piston 206 and the second bore 208 are axially aligned with axis A-A. The actuation piston 206 is moveable within the second bore 208. The actuation piston 206 is axially slidable within the second bore 208. In some embodiments the actuation piston 206 and the fuel injection piston 200 are integral or mechanically coupled together. In other embodiments the actuation piston 206 can be remote from the fuel injection piston 200 such that the pistons 200, 206 are separate moveable elements.

An upper surface 210 of the actuation piston 206 is adjacent to and in contact with an actuation liquid within an actuation chamber 212. The actuation liquid is part of a high pressure hydraulic system having an actuation liquid reservoir 216. The actuation chamber 212 is in fluid communication with the actuation liquid inlet port 114 via an actuation liquid supply conduit 214. The supply of the high pressure actuation liquid is controlled with an actuation control valve 218. The actuation control valve 218 selectively controls the flow of the actuation liquid to the actuation chamber 212. The reservoir 216 of the actuation liquid may be an existing source, such as a common rail system or a cam-shaft system, for providing actuation liquid of high pulsating pressure. In this way the actuation control valve 218 controls when the high pressure actuation liquid enters the actuation chamber 212 and urges the fuel injection piston 200 towards the first end 104.

When the actuation piston 206 moves upwards towards the second end 106, then actuation liquid egresses from the actuation chamber 212 back to the actuation liquid reservoir 216 via a low pressure drain line (not shown). This means that the actuation liquid is recycled and reused for subsequent injection cycles.

In other embodiments the actuation system can be any suitable means for exerting a force on the fuel injection piston 200. In some embodiments the actuation liquid is also the sealing liquid. This means that there is no sealing liquid reservoir 220 and the sealing liquid reservoir is also the actuation liquid reservoir 216. In one embodiment (not shown in FIG. 2), the sealing control valve 222 is coupled to the actuation liquid reservoir 216. This means that the sealing control valve 222 delivers actuation liquid to the sealing liquid inlet port 112. Alternatively a conduit (not shown) is coupled to the sealing liquid inlet port 112 and is in fluid communication with a component of the actuation liquid system, such as the actuation liquid reservoir 216, the actuation liquid control valve 218 and/or the actuation liquid inlet port 114. In such arrangements, the functionality of the sealing liquid is the same as previously discussed, except that the sealing liquid is the actuation liquid.

The fuel injection piston 200 is arranged to pressurise the slurry fuel in the pump chamber 120 by virtue of the high pressure actuation liquid exerting a high pressure or force on the actuation piston 206.

The slurry fuel contains hard wearing particles which wear and damage the fuel injector valve 102. Accordingly a sealing arrangement is provided to seal the fuel system, which contains the slurry fuel, from other parts of the fuel injection. Sealing liquid is used to separate and isolate the slurry fuel as well as lubricate moving parts. The sealing liquid arrangement will be discussed in further detail with reference to FIGS. 2 and 3.

Coal-water slurry fuels typically contain no oil, whereby sealing and lubricating properties of coal-water slurry fuels are typically substandard or absent. Optionally in some embodiments a sealing liquid is provided for moving parts for lubrication purposes and for preventing migration of solid particles within the fuel injector valve 102. The sealing liquid can also prevent build-up of sludge and accumulation of carbonaceous particles in any deposits.

The sealing liquid is supplied from a sealing oil reservoir 220 to the sealing liquid inlet port 112 via a sealing control valve 222. The sealing liquid inlet port 112 is in fluid communication with a groove 224 on the fuel injection piston 200 via sealing piston conduit 226. The groove 224 is located around the outer peripheral cylindrical surface of the fuel injection piston 200. In some embodiments the groove 224 is a circumferential groove. In some embodiments there may be a plurality of circumferential grooves 224, each for receiving sealing liquid for lubricating and sealing the fuel injection piston 200. The sealing liquid fills a clearance between the first and/or second bores 202, 208 in the housing 110 and the fuel injection piston, or pump piston, 200 and/or the actuation piston 206. This seals the clearance between the pump chamber 120 and the actuation liquid chamber 212.

By selecting the above clearance for the lower part of the pump piston 200 slightly larger than the clearance for the upper part of the pump piston 200 towards the first end 104 of the fuel injector valve 102, most of the sealing liquid flows through the clearance towards the pump chamber 120. Excess sealing liquid will mix with the slurry fuel in the pump chamber 120 and be combusted.

The sealing liquid inlet port 112 is also in fluid communication with at least one circumferential groove 228 around the moveable valve needle 134 via a nozzle sealing liquid conduit 230. The sealing arrangement around the nozzle 108 will be discussed in further detail with respect to FIG. 3.

Turning back to FIG. 3, the nozzle sealing liquid conduit 230 is in fluid communication with a sealing liquid nozzle outlet 232. The sealing liquid nozzle outlet 232 is in fluid communication with at least one circumferential groove 228 on the moveable valve needle 134. In some embodiments there is a plurality of circumferential grooves 228*a*, 228*b*, 228*c*, 228*d*, on the moveable valve needle 134. In the embodiment shown in FIG. 3 there are four circumferential grooves 228*a*, 228*b*, 228*c*, 228*d*. In some embodiments there can be any number of circumferential sealing grooves. The sealing liquid migrates from the sealing liquid nozzle outlet 232 between the clearance of the outer surface of the movable valve needle 134 and the surface of the longitudinal bore 132.

The circumferential grooves 228*a*, 228*b*, 228*c*, 228*d* may be rectangular or round faced turned into the moveable valve needle 134 on a face of the moveable valve needle 134 being in direct contact with, or directly facing, the longitudinal bore 132.

The plurality of the circumferential grooves 228*a*, 228*b*, 228*c*, 228*d* is disposed in an intermediate portion 234 of the moveable valve needle 134. The intermediate portion 234 substantially coincides with the portion of the longitudinal bore 132 being closest to the needle fuel chamber 144. The circumferential grooves 228*a*, 228*b*, 228*c*, 228*d* are substantially equidistantly spaced over the intermediate portion 234.

The arrangement of providing the circumferential grooves 228*a*, 228*b*, 228*c*, 228*d* with sealing liquid has the effect that the moveable valve needle 134 is maintained at a central coaxial position in respect of the valve seat 138, thus the provision of sealing liquid in the clearance between the face of the moveable valve needle 134 and the longitudinal bore 132 facilitates that this clearance is occupied by incompressible sealing liquid and hence preventing the moveable valve needle 134 from deviating from a position aligned with the longitudinal axis A-A.

Optionally to increase sealing between the moveable valve needle 134 and the longitudinal bore 132, the pressure of the sealing liquid can be sufficient to promote a flow of sealing liquid into the needle fuel chamber 144. In this way sealing liquid drains from the circumferential grooves 228*a*, 228*b*, 228*c*, 228*d* and on to the needle seat 138. This causes the sealing liquid to mix with the slurry fuel in the needle fuel chamber 144. The sealing liquid in some embodiments is a liquid hydrocarbon oil, such as diesel oil, that burns easier than the slurry fuel. Accordingly, sealing liquid draining into the fuel chamber 144 can promote the combustion of the slurry fuel in the combustion chamber 300.

Figure 7:
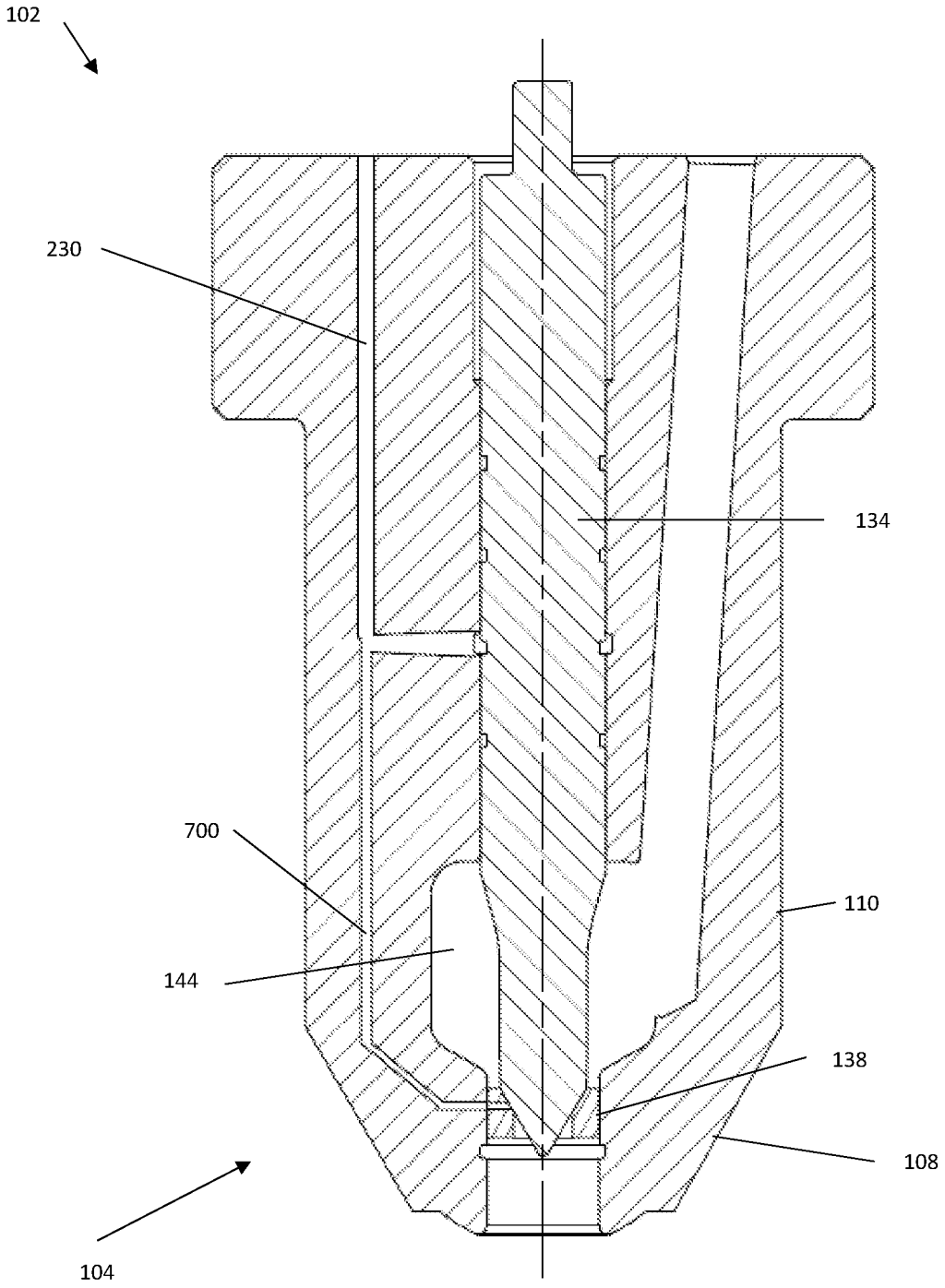
FIG. 7 shows a partial cross sectional side view of a nozzle of a fuel injector valve.

Turning to FIG. 7, a further embodiment will now be discussed. FIG. 7 discloses a partial cross section of the nozzle 108 of the fuel injector valve 102. Optionally there is an additional conduit 700 in fluid communication with the needle valve seat 138 and the nozzle sealing liquid conduit 230. By adding the sealing liquid to the slurry fuel in the needle valve seat 138, the sealing liquid is added to the slurry fuel at the very last moment before the slurry fuel is injected into the combustion chamber 300. This means that the sealing liquid has the minimum amount of time to negatively affect the slurry fuel. For example, diesel oil can negatively affect and destabilise micronized refined carbon (MRC) slurry fuel.

Additionally or alternatively the additional conduit 700 is in fluid communication with the needle fuel chamber 144. The connection between the additional conduit 700 and the needle fuel chamber 144 is not shown. In this way the additional conduit 700 connects the nozzle sealing liquid conduit 230 to the needle fuel chamber 144. This means that the nozzle sealing liquid conduit 230 provides sealing liquid to the needle valve seat 138 and/or the needle fuel chamber 144. Although one additional conduit 700 is shown in FIG. 7, in other embodiments a plurality of additional conduits 700 is provided for fluid communication between the nozzle sealing liquid conduit 230 and the needle valve seat 138, the needle fuel chamber 144, and/or any other part of the nozzle 108.

As mentioned above, the sealing liquid is typically a lighter hydrocarbon which burns more easily than the slurry fuel. This means that the sealing liquid can be used as a pilot fuel to improve the combustibility of the slurry fuel. In this way, the sealing liquid supplied by the source of sealing liquid 220 may be used to improve the lubricity and ignitability performance. As a result, the wear of the moveable valve needle 134 and the tip 136 abrading against the needle seat 138 due to shortage of the lubrication is limited.

In some embodiments the rate of flow of the sealing liquid to the needle fuel chamber 144 and/or the needle valve seat 138 can be varied and controlled. This means that the amount of sealing liquid used as a pilot fuel can be adjusted depending on the characteristics of the slurry fuel.

Figure 4:
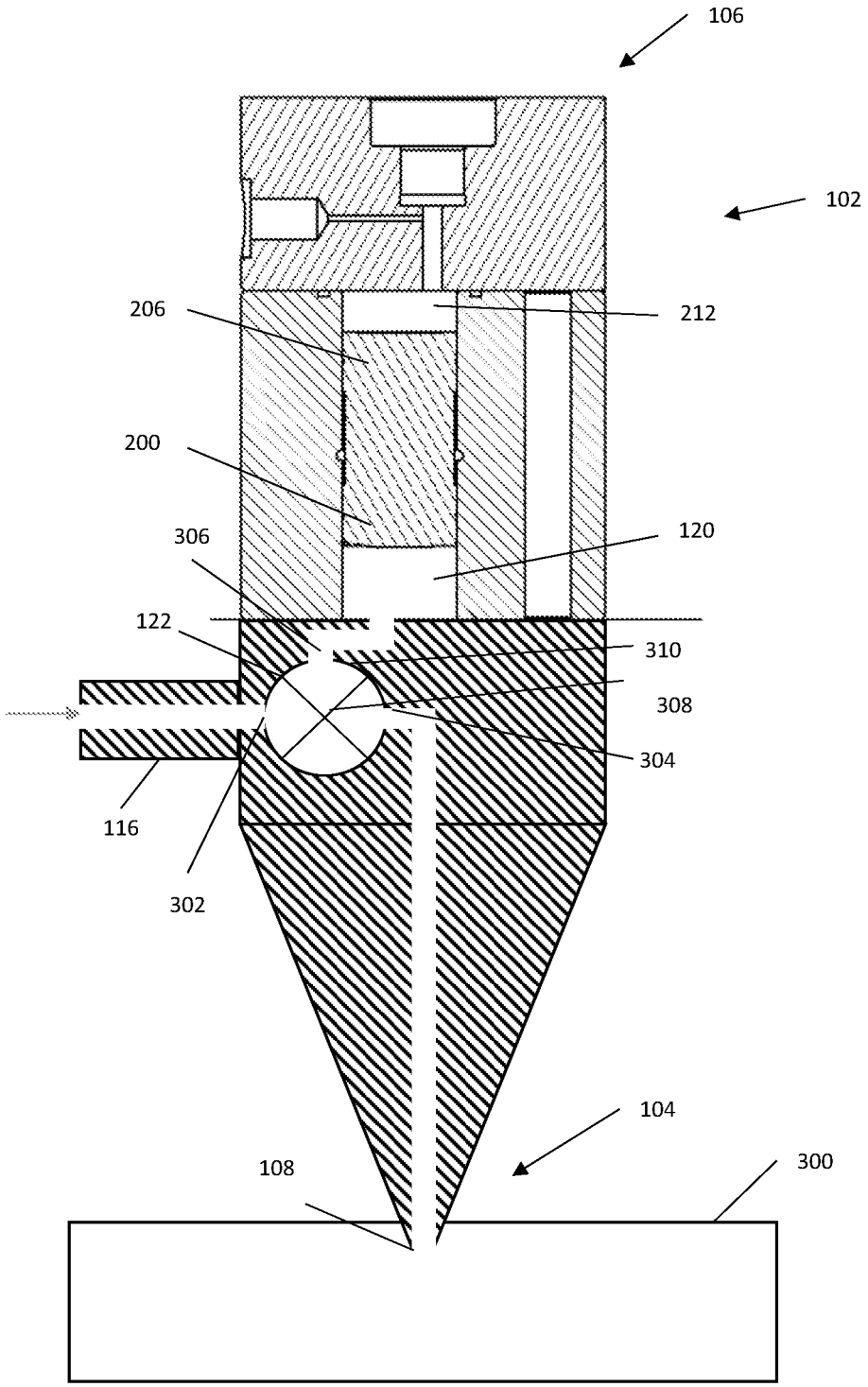
FIG. 4 shows another cross sectional schematic side view of a fuel injector valve according to an embodiment.

A fuel supply valve 122 for use in a fuel injector valve 102 will now be discussed in further detail with respect to FIG. 4. FIG. 4 is a schematic representation of the fuel injector valve 102. For the purposes of clarity, the sealing liquid and the corresponding valves and conduits have not been shown. The moveable valve needle 134 and the corresponding structural features in the nozzle 108 have also been omitted for clarity.

The fuel supply valve 122 controls the flow of the slurry fuel into the fuel injector valve 102. In some embodiments the fuel supply valve 122 is mounted inside the fuel injector valve 102. In other embodiments the fuel supply valve 122 is mounted between the fuel reservoir 118 and the pump chamber 120. In some embodiments the fuel supply valve 122 is a one-way valve. This means that the slurry fuel can only flow into the fuel injector valve 102. Alternatively the fuel supply valve 122 is a two way valve, but the fuel supply valve 122 is selectively controlled to open only when the pressure in the pump chamber 120 is less than the pressure of the slurry fuel in the fuel inlet port 116.

The fuel supply valve 122 is in fluid communication between the fuel inlet port 116 and the pump chamber 120. In some embodiments the fuel inlet port 116 is arranged in the fuel supply valve 122. Alternatively the fuel inlet port 116 is remote from the fuel supply valve 122.

The slurry fuel is in some embodiments pressurised at a pressure of 1 bar to 20 bar. In other embodiments the slurry fuel is at a pressure of 6 bar to 15 bar. It is to be noted that there are three separate liquids that are supplied to the fuel injector valve 102. The sealing liquid, the actuation liquid, and the slurry fuel are all at different pressures. The different pressures may be provided to accommodate different functions of the sealing liquid, the actuation liquid and the slurry fuel.

The fuel supply valve 122 comprises a supply valve fuel inlet 302 in fluid communication with the fuel reservoir 118 via the fuel inlet port 116. The supply valve fuel inlet 302 is arranged to let the slurry fuel flow into the fuel supply valve 122. The fuel supply valve 122 further comprises a supply valve fuel outlet 304 in fluid communication with the nozzle 108 of the fuel injector valve 102. As noted above, however, in some embodiments the nozzle fuel conduit bypasses the fuel supply valve 122, so that fuel can flow from the pump chamber 120 to the nozzle 108 without passing through the fuel supply valve 122, and so the supply valve fuel outlet 304 may be omitted. The fuel supply valve 122 also comprises a pump chamber port 306 in fluid communication with the pump chamber 120 of the fuel injector valve 102.

The fuel supply valve 122 comprise a supply valve moveable element 308 mounted within a valve chamber in a fuel supply valve housing 310. The supply valve moveable element 308 in some embodiments is a moveable valve gate 308. The moveable valve gate 308 may be selectively located to define one or more slurry fuel flow paths in the fuel supply valve 122. In some embodiments the valve gate 308 comprises a conduit with a moveable slurry fuel flow path. In other embodiments the valve gate 308 is a solid element which diverts the flow of the slurry fuel between a first slurry fuel path and a second slurry fuel path.

The valve gate 308 is moveable in the valve chamber between a first position wherein the supply valve fuel inlet 302 is in fluid communication along a first slurry fuel flow path with the pump chamber port 306 and a second position wherein the supply valve fuel outlet 304 is in fluid communication along a second slurry fuel flow path with the pump chamber port 306.

In this way the valve gate 308 selectively controls flow of the slurry fuel from the supply valve fuel inlet 302 to the pump chamber 120. Furthermore the fuel supply valve 122 selectively controls whether the pump chamber 120 is connected to the fuel inlet port 116 or the nozzle 108 of the fuel injector valve 102. In the first position the fuel supply valve 122 is open with respect to the fuel inlet port 116 and allows the slurry fuel to flow into the pump chamber 120. In the second position the fuel supply valve 122 is closed with respect to the fuel inlet port 116 and the slurry fuel is not allowed to flow into the pump chamber 120.

The functionality of the fuel supply valve 122 will now be discussed. In a first filling phase, the valve gate 308 is in the first position and the slurry fuel flows through the fuel supply valve 122 into the pump chamber 120. The pressure of the slurry fuel is sufficient to push the fuel injection piston 200 upwards towards the second end 106. As the fuel injection piston 200 and the actuation piston 206 are pushed upwards to the second end 106, a portion of the actuation liquid in the actuation chamber 212 flows back into the actuation liquid reservoir 216.

In a second valve cut-off phase the pump chamber 120 becomes full with the slurry fuel. At this stage the valve gate 308 of the fuel supply valve 122 moves from the first position to the second position. The fuel inlet port 116 is no longer in fluid communication with the pump chamber 120. When the supply valve moveable element 308 moves between the first and second positions, the moveable element does not substantially exert a force opposing a flow of the slurry fuel into the pump chamber 120. This means that the slurry fuel can be maintained at a low pressure and the action of the fuel supply valve 122 opening and closing does not increase the pressure on the slurry fuel. This means that the fuel supply valve 122 exerts minimal additional pressure on the slurry fuel and limits the chances of the non-Newtonian slurry fuel precipitating out or the solid fuel particles agglomerating. This avoids the fuel supply valve 122 causing misfires due to clogging of the slurry fuel in the fuel supply valve 122 or the pump chamber 120.

In some embodiments the opposing force of the valve gate 308 against the flow of the slurry fuel is less than 170 N. In further embodiments the opposing force of the valve gate 308 against the flow of the slurry fuel is less than 150 N. In yet further embodiments the opposing force of the moveable element 308 against the flow of the slurry fuel is less than 100 N. In yet further embodiments the opposing force of the valve gate 308 against the flow of the slurry fuel is less than 50 N. In yet further embodiments the opposing force of the valve gate 308 against the flow of the slurry fuel is less than 25 N. In yet further embodiments the opposing force of the valve gate 308 against the flow of the slurry fuel is less than 10 N. In yet further embodiments the opposing force of the moveable element 308 against the flow of the slurry fuel is less than 5 N. In yet further embodiments the opposing force of the valve gate 308 against the flow of the slurry fuel is approximately or equal to 0 N.

In a third injection phase the actuation liquid control valve 218 opens and high pressure actuation liquid rapidly flows into the actuation chamber 212. Since the actuation liquid is at a much greater pressure than the slurry fuel in the pump chamber 120, a force urges the fuel injection piston 200 rapidly towards the first end 104. This causes the slurry fuel to be pressurised and forced into the needle fuel chamber 144. In some embodiments this is the only time that the slurry fuel is exposed to a high pressure, to limit the chances of the slurry fuel precipitating or agglomerating. The pressure of the slurry fuel causes the needle piston 148 to recoil and move the moveable needle valve 134 into an open position. The slurry fuel is then pushed into the combustion chamber 300.

In a fourth valve open phase, the spring 142 urges the needle piston 148 and the moveable valve needle 134 to the closed position. The valve gate 308 of the fuel supply valve 122 moves into the first position. The cycle then starts again with the first filling phase.

In some embodiments, the fuel supply valve is actuated with a motor and electronic control system. In other embodiments the fuel supply valve is actuated with a gearing system coupled and synced to the engine timing. In other embodiments the fuel supply valve is actuated with any suitable means for actuating and moving the valve gate 308.

Figure 5:
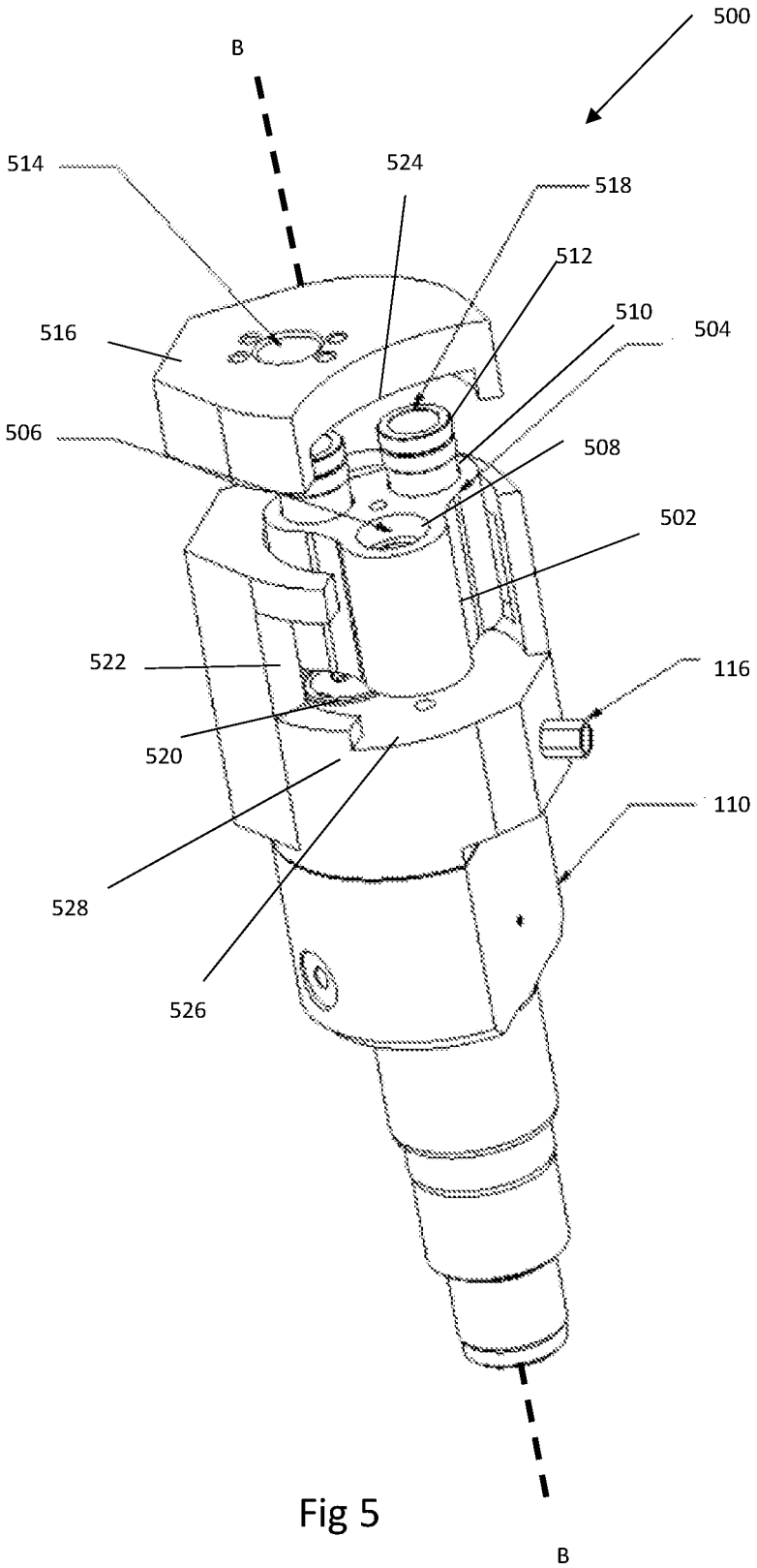
FIG. 5 shows a perspective view with partial cut-away of a fuel injector valve and fuel supply valve according to an embodiment.

Turning now to FIG. 5, another embodiment of a fuel supply valve 502 of a fuel injector valve 500 will now be discussed. FIG. 5 shows a perspective view with a partial cut-away of the fuel injector valve 500.

The fuel injector valve 500 is similar to the fuel injector valve 102 as discussed with reference to previous embodiments. The fuel injector valve 500 comprises a different structure of the fuel supply valve 502, which will be discussed in further detail now.

The fuel injector valve 500 comprises a moveable cartridge 504. The moveable cartridge 504 may be considered to comprise a valve gate. The moveable cartridge 504 in some embodiments is rotatable about the longitudinal axis B-B of the fuel injector valve 500. The rotatable cartridge 504 comprises a plurality of chambers 506 which are circumferentially distributed around the rotatable cartridge 504. FIG. 5 shows three chambers 506 spaced around the axis B-B. However, in other embodiments there can be any number of chambers in the cartridge 504. For example there can be two chambers 506 or four chambers 506.

The rotatable cartridge 504 is rotatably mountable on a bearing surface (not shown) within a reciprocal cartridge chamber 520. The cartridge chamber 520 allows free rotation of the rotatable cartridge 504 therein. The cartridge chamber 520 is defined by side walls 522 of the housing 110. An upper surface 524 of the cartridge chamber 520 is provided by an injector fuel valve cap 516. A lower surface 526 of the cartridge chamber 504 is defined by an intermediary wall 528. The bearing surfaces of the rotatable cartridge 504 are respectively located on the lower and upper surfaces 526, 524.

Each chamber 506 comprises a longitudinal bore 508 which is substantially parallel with the axis B-B. The longitudinal bore 508 in some embodiments is an open bore such that slurry fuel is able to enter the bore from the underside and actuation liquid is able to enter the bore from above. A fuel injection piston 510 and an actuation piston 512 are provided in each longitudinal bore 508. The fuel injection piston 510 and actuation piston 512 are part of the same shuttle piston 518 and are slidably disposed in the longitudinal bore. The arrangement of each of the chambers 506 and the fuel injection piston 510 and the actuation piston 512 is the same as the fuel injection valve 102 discussed in respect of the previous embodiments. In this way the chambers 506 can be similarly considered to be a pump chamber 120 and an actuation chamber 212.

Similar to the previous embodiments, optionally, a sealing liquid is provided to lubricate and seal the pump chamber 120 and the actuation chamber 212. In addition one or more rotation cartridge sealing liquid conduits may be provided to seal and lubricate the rotatable chamber 504. The one or more rotation cartridge sealing liquid conduits are provided at the bearing surfaces on the lower and upper surfaces 526, 524. This means that the sealing liquid is provided around a lip of the periphery of each pump chamber 120 on the rotation cartridge 504 and prevents the slurry fuel from contaminating the rotation mechanism of the rotation cartridge.

The actuation piston 512 is in fluid communication with the high pressure actuation reservoir 216 via actuation liquid port 514. The actuation liquid port 514 is located in an injector fuel valve cap 516. The injector fuel valve cap 516 is mountable on the housing 110. The functionality and arrangement of the actuation liquid is the same as previously discussed embodiments.

The rotatable cartridge 504 rotates and sequentially positions each chamber 506 in a different relative position with respect to the actuation liquid port 514, the supply valve fuel inlet and the supply valve fuel outlet. The supply valve fuel inlet and the supply valve fuel outlet and their respective fluid connections through the fuel valve injector 500 are the same as the previously described fuel valve injector 102.

In a first rotation position the rotatable cartridge 504 is positioned such that the pump chamber 120 is in fluid communication with the supply valve fuel inlet. The fuel inlet port 116 receives fuel from the fuel reservoir 118 and the fuel inlet port 116 is in fluid communication with the supply valve fuel inlet.

The slurry fuel is maintained at a low pressure when the slurry fuel flows into the pump chamber 120 of a first chamber 506 of the rotation cartridge 504. The slurry fuel is kept at a pressure between 6 bar and 15 bar when the slurry fuel enters the fuel supply valve 502.

In a second rotation position the rotatable cartridge 504 rotates such that the pump chamber 120 of the first chamber 506 of the rotation cartridge 504 is aligned with the supply valve fuel outlet. At the same time the actuation chamber 212 is aligned with the actuation liquid port 514. In the second position, the fuel injector valve is ready to fire and drive the slurry fuel in the pump chamber 120 to the nozzle 108. The arrangement of the nozzle 108 is the same as described with reference to the previous embodiments.

In some embodiments the first chamber 506 of the rotation cartridge 504 is then rotated back to the first rotation position so that the pump chamber 120 is ready to be filled again.

Optionally, the rotation cartridge moves the first chamber 506 of the rotation cartridge 504 to a third rotation position. In the third position, the rotatable cartridge is aligned with a flushing port (not shown). The flushing port is connected to a flushing medium system (not shown) that flushes the pump chamber 120 and the actuation chamber 212 in between the second position and the first position. The flushing medium system delivers a flushing liquid to the rotatable cartridge 504. In other words, the flushing stage occurs between the filling stage and the injection stage.

This mitigates the likelihood that the fuel will build up inside the chamber and cause blockages. The flushing system delivers flushing medium to both the top and bottom of the shuttle piston 518.

In some embodiments the flushing liquid is provided firstly to the bottom of the shuttle piston 518 in the pump chamber 120, forcing the shuttle piston 518 to the top dead centre position. The remaining actuating liquid on or at the top of the chamber 506 is collected and sent to the actuating liquid reservoir 216. The collection of the actuation liquid is similar to the process as discussed with respect to the previous embodiments. Flushing medium is then pumped into the top chamber, forcing the piston to bottom dead centre and evacuating the flushing medium from the lower chamber.

The rotation cartridge 504 as shown in FIG. 5 comprises three chambers 506 with three respective rotation positions. However, there may be a greater number of rotation positions and chambers 506. This may for example be advantageous if the filling of the low pressure slurry into the pump chamber 120 is the slowest step of the injection process.

In some embodiments the revolving cartridge 504 is rotated using hydraulic oil from a servo oil system (not shown) from the engine 100. In this way the timing of the rotatable cartridge 504 is driven by the speed of the engine 100. A hydraulic piston (not shown) connected to a spur gear (not shown) allows the rotating cartridge 504 to rotate about the axis B-B. A geared system (not shown) ensures that the chambers 506 line up with their respective filling and fuel egress ports in the first, second and third rotation positions. Additionally the geared system may ensure a good seal is maintained.

The rotation of rotatable cartridge 504 ensures that the slurry fuel is selectively controlled in each chamber 506. The rotation of the rotatable cartridge 504 is substantially transverse to the direction of flow of the slurry fuel into the pump chamber. The rotation of the rotatable cartridge 504 rotates across the flow of the slurry fuel. This means that the force of rotating the rotatable cartridge 504 on the slurry fuel is minimal.

In alternative embodiments the rotatable cartridge 504 is rotated with other means, for example a separate motor and electronic control system. The rotatable cartridge can be operated with any other suitable means for rotating the cartridge 504 between the different positions.

Figure 6A:
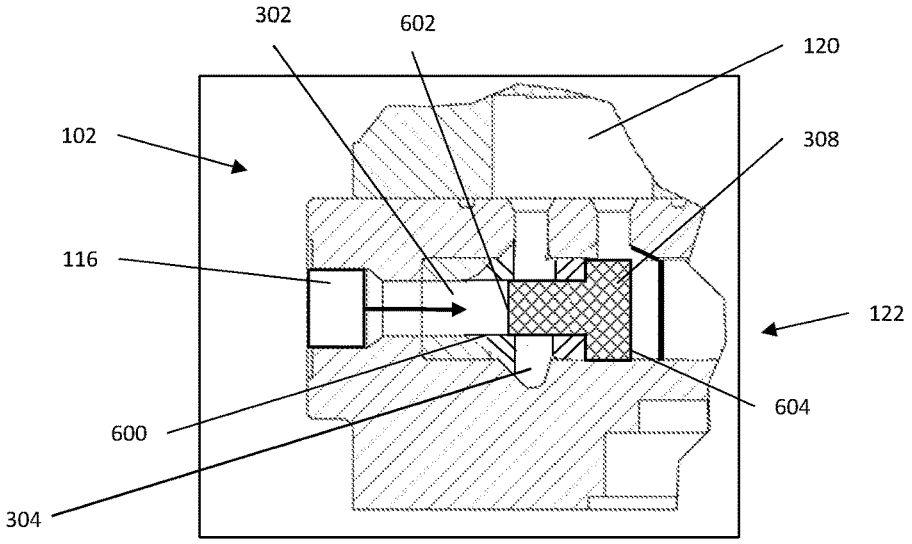
FIGS. 6*a* to 6*c* show cross sectional side views of a fuel supply valve of a fuel injector valve according to an embodiment, showing respective sequential steps of the fuel supply valve moving between first and second positions.
Figure 6B:
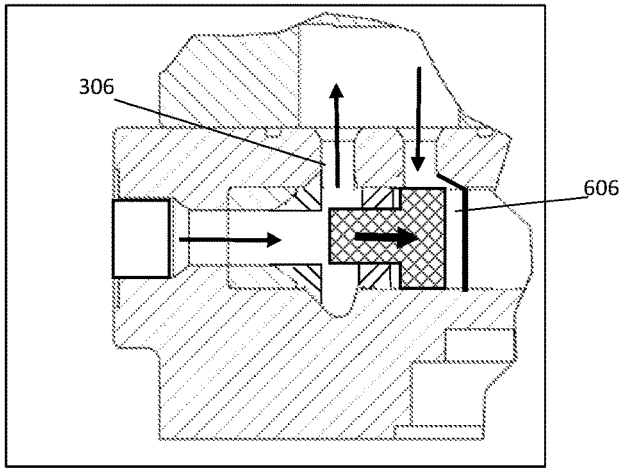
Figure 6C:
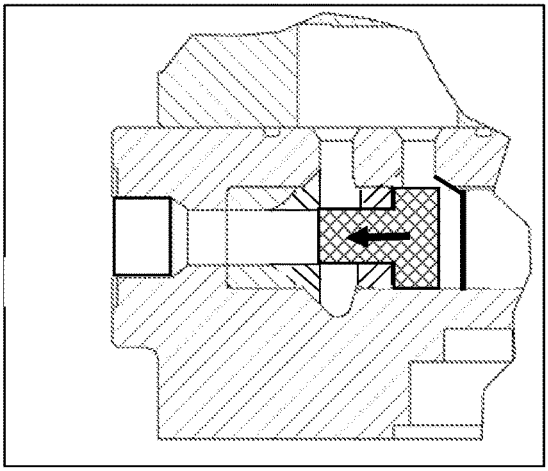

Another embodiment will now be discussed with reference to FIGS. 6*a* to 6*c*. FIGS. 6*a* to 6*c* are partial cross sectional side views of the fuel supply valve 122 of the fuel injection valve 102. FIGS. 6*a* to 6*c* are sequential steps of the fuel supply valve 122 moving between the first and second positions.

The fuel injector valve 102 is the same as shown in FIG. 2, except for the form of the fuel supply valve 122 and the pump chamber 120.

The fuel supply valve 122 is integral with the housing 110 of the fuel injector valve 102. The structure of the fuel supply valve 122 and the pump chamber 120 have been modified and this will now be discussed in further detail.

In FIG. 6*a* the fuel supply valve 122 is in the second position in which the fuel inlet port 116 and the supply valve fuel inlet 302 are not in fluid communication with the pump chamber 120, and the supply valve fuel outlet 304 is in fluid communication with the nozzle 108. The moveable element 308 is seated in fuel supply valve seat 600 and this cuts off the fuel inlet port 116 (and, in some embodiments, the supply valve fuel outlet 304) from the pump chamber 120. That is, in some embodiments, the supply valve fuel outlet 304 is in fluid communication with the pump chamber 120 when the fuel supply valve 122 is in the second position, and in some other embodiments the supply valve fuel outlet 304 is out of fluid communication with the pump chamber 120 when the fuel supply valve 122 is in the second position. The moveable element 308 is arranged to generate minimal static and dynamic friction so that that slurry fuel can push the valve gate 308.

The valve gate 308 comprises an inlet surface 602 and a chamber surface 604. The surface area of the inlet surface 602 is smaller than the surface area of the chamber surface 604. Accordingly the fuel supply valve 122 is a differential area valve.

The slurry fuel enters the fuel supply valve 122 at the fuel inlet port 116. The pump chamber 120 is empty in FIG. 6*a*. This means that the pressure of the fuel $P_{fuel}$ exerted on the inlet surface 602 is greater than the pressure $P_{chamber}$ exerted on the chamber surface 604 in the pump chamber 120. Accordingly, the pressure of the slurry fuel exerts a force in the direction of the arrow as shown in FIG. 6*a*.

In FIG. 6*b*, the resultant force of the pressure $P_f$ of the slurry fuel on the inlet surface 602 moves the valve gate 308 out of the valve seat 600. This means that the fuel supply valve 122 moves from the second position into the first position. Now the fuel inlet port 116 and the supply valve fuel outlet 304 are in fluid communication with the pump chamber port 306. The slurry fuel flows into the pump chamber 120.

The slurry fuel flows into the pump chamber 120 and also into a spool valve conduit 606. The spool valve conduit 606 houses a portion of the moveable element 308 and the chamber surface 604 and is in fluid communication with the pump chamber 120. Accordingly as the pump chamber 120 fills with the slurry fuel, the spool valve conduit 606 also fills with the slurry fuel.

The resultant force R of on the moveable valve element 308 is determined by the force exerted on the inlet surface 602:

$$F_{inlet}=P_{fuel}\times A_{inlet}$$

and the force exerted on the chamber surface 604:

$$F_{chamber}=P_{chamber}\times A_{chamber}$$

This means that when $F_{inlet}>F_{chamber}$, the resultant force will urge the valve gate 308 into the first position where the fuel supply valve allows the slurry fuel into the pump chamber 120.

As the pump chamber 120 fills up, the slurry fuel is present both in the supply valve fuel inlet 302 and the pump chamber 120 and the spool valve conduit 606. When the pressure equalises on both sides of the valve gate 308, then $$F_{inlet}<F_{chamber}$$

Accordingly the resultant force on the valve gate 308 causes the valve gate 308 to move from the first position to the second position as shown in FIG. 6*c*. The inertia of the moving valve gate 308 ensures that the valve gate 308 seats in the fuel supply valve seat 600 and closes off the flow of the fuel slurry. In some embodiments optionally a soft spring (not shown) can be provided to urge the moveable element towards the second position. The soft spring is configured to exert a low force on the gate 308 to return the gate to its original position as shown in FIGS. 6*a* and 6*c*.

The pump chamber 120 is now full of slurry fuel and the supply valve fuel outlet 304 and the nozzle 108 are in fluid communication with the pump chamber 120. This means that the pump piston 200 can inject the slurry fuel to the nozzle 108 ready for combustion.

This means that the pressure of the slurry fuel can be used to actuate the fuel supply valve 122. This means that the slurry fuel is only exposed to a high pressure in the fuel injector valve 102 as it is driven to the nozzle 108. This limits the chances of the non-Newtonian slurry fuel behaving adversely in the fuel system.

The other steps of the fuel injector valve 102 and the structural features of the fuel injector valve 102 are the same as previously discussed in respect of earlier embodiments.

Figure 8:
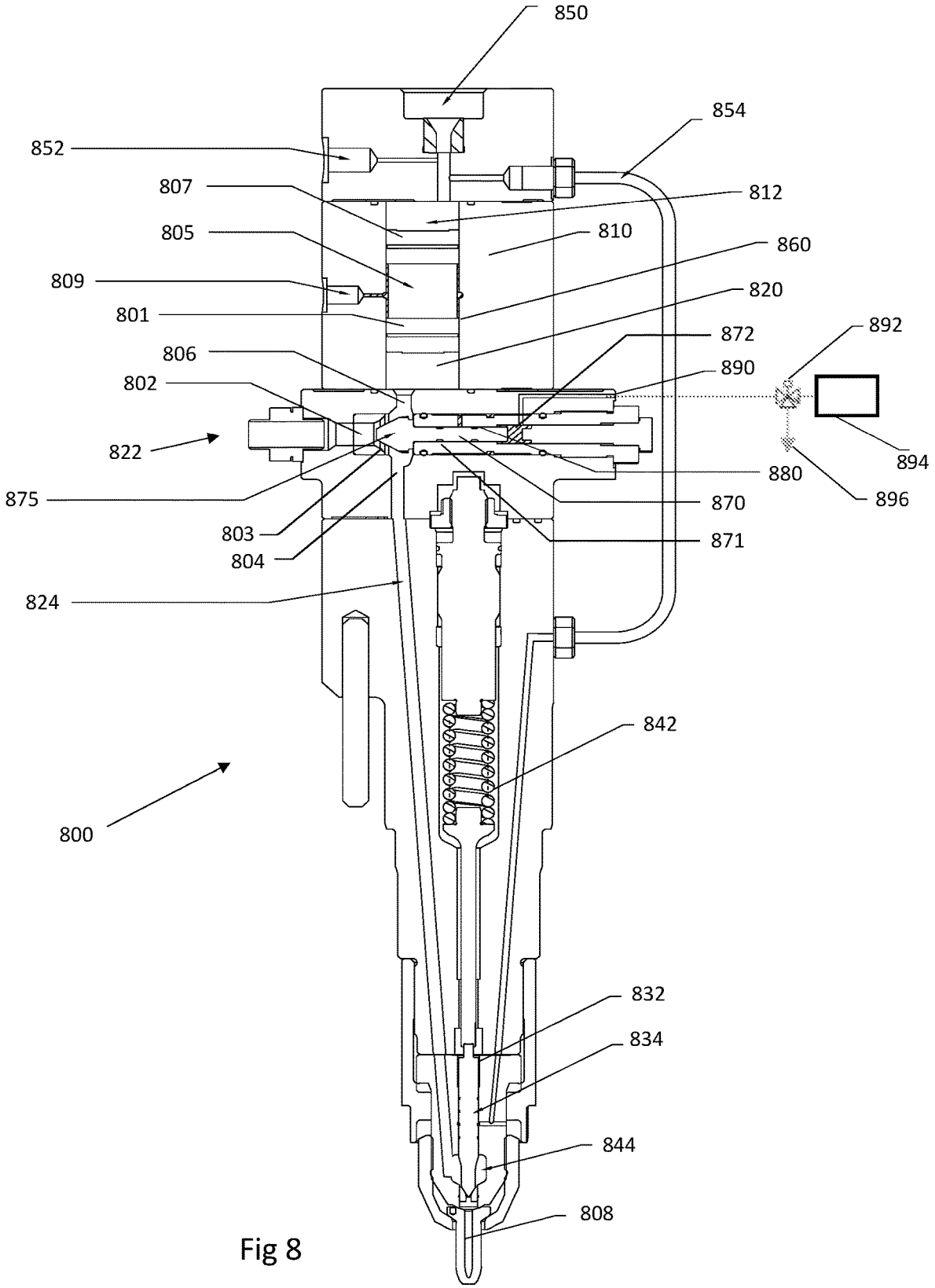
FIG. 8 shows a cross sectional schematic side view of a fuel injector valve according to another embodiment.
Figure 9:
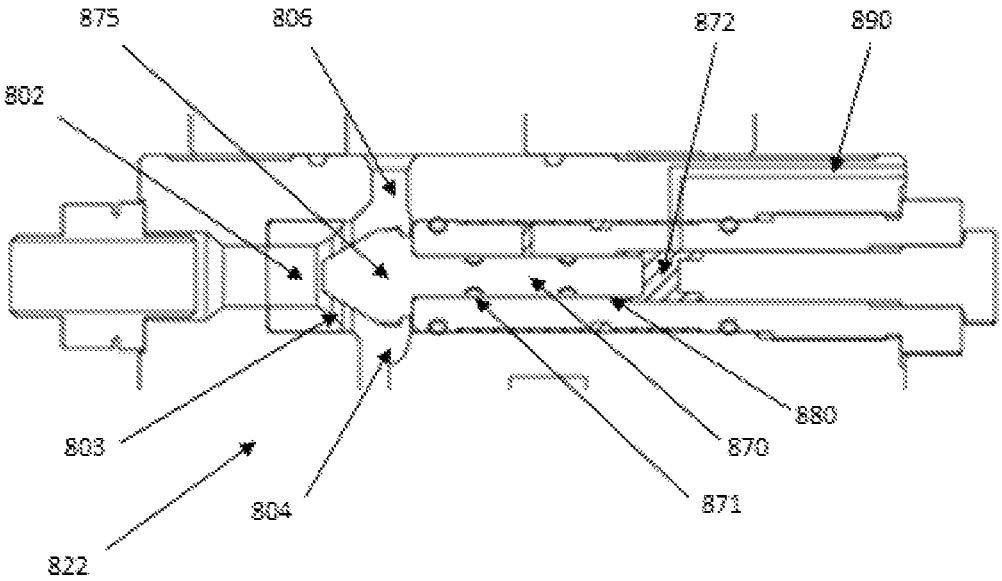
FIG. 9 shows a cross sectional schematic side view of a fuel supply valve of the fuel injector valve of FIG. 8.

FIG. 8 shows a cross sectional schematic side view of a fuel injector valve according to another embodiment. The fuel injector valve 800 of FIG. 8 is a slurry fuel injector valve, and incorporates a fuel supply valve 822 that is itself an embodiment of the present invention. A cross sectional schematic side view of the fuel supply valve 822 is shown in FIG. 9. An overview of the fuel injector valve 800 will be provided first, followed by more a detailed explanation of its component parts.

The fuel injector valve 800 is similar to the fuel injector valve 102 of FIG. 2, and the discussion herein will focus primarily on differences between the two in the interest of brevity.

The fuel injector valve 800 comprises a nozzle 808 via which slurry fuel exits the injector valve 800 towards a combustion chamber of an engine in use. The engine may be any of the types of engine discussed above, such as a marine engine.

The fuel injector valve 800 also comprises a housing 810, a pump cavity 860 within the housing 810, and a fluid-actuatable pump element 805 that divides the pump cavity 860 into a pump chamber 820 and an actuation chamber 812. The pump chamber 820 is for receiving the slurry fuel from the fuel supply valve 822. The actuation chamber 812 is for receiving actuation liquid to act on the pump element 805 to pump the slurry fuel from the pump chamber 820 to the nozzle 808 in use. These processes are described in more detail below.

The fluid-actuatable pump element 805 in this embodiment is a shuttle piston 805, which is slidably movable in the pump cavity 860. Shuttle seal oil is delivered to a clearance between the shuttle piston 805 and a surface of the pump cavity 860 from a shuttle seal oil inlet 809 that opens into the pump cavity 860. The shuttle seal oil lubricates the shuttle piston 805 and helps to isolate the actuation chamber 812 from the pump chamber 820.

The shuttle piston 805 comprises a pump piston 801 that is slidably mounted in the pump chamber 820 and arranged to exert a force on the slurry fuel in use, and an actuation piston 807 that is coupled to the pump piston 801 and arranged to transmit a force to the pump piston 801 in use. In this embodiment, the axis along which the pump piston 801, and indeed the whole shuttle piston 805, moves is offset from a longitudinal axis of the injector 800. In some embodiments, the fluid-actuatable pump element 805 may be other than a shuttle piston, and may not be slidibly movable in the pump cavity 860. For example, in some embodiments, the pump element 805 may be a diaphragm of a diaphragm pump. In some embodiments, the pump element 805 may be other than fluid-actuatable, such as actuatable by a mechanical driver.

The fuel injector valve 800 further comprises the fuel supply valve 822 for selectively placing the pump chamber 820 in fluid communication with a fuel inlet 802 of the fuel supply valve 822. The fuel supply valve 822 will now be described in more detail with continuing reference to FIG. 8.

The fuel supply valve 822 comprises the fuel inlet 802, which is for fluid communication with a slurry fuel reservoir. The slurry fuel reservoir is not shown in FIG. 8, but by way of example any of the above described arrangements of slurry fuel reservoir(s) may be used.

The fuel supply valve 822 also comprises a fuel outlet 804 for fluid communication with the nozzle 808 of the fuel injector valve 800. In this embodiment, the fuel outlet 804 is in fluid communication with a needle fuel chamber 844 via one or plural nozzle fuel conduits 824. Since MRC has a relatively low calorific property, relatively more fuel is required to generate a certain amount of power. The provision of more than one nozzle fuel conduit 824 permits more MRC to reach the nozzle 808 and thus increase the energy-per-injection-cycle. The provision of more than one fuel injector valves 800 in an engine also can permit more MRC to reach the respective nozzles 808 of the fuel injector valves 800 and thus increase the energy per cycle of the engine.

The arrangement of the needle fuel chamber 844 and the nozzle fuel conduit(s) 824 substantially corresponds to that of the fuel injector valve 102 of FIG. 2, and so will not be described in the interest of brevity.

The fuel supply valve 822 also comprises a pump chamber port 806 for fluid communication with the pump chamber 820. In this embodiment, the pump chamber port 806 is in permanent fluid communication with the pump chamber 820, but in other embodiments a valve may be provided to control fluid flow between the pump chamber port 806 and the pump chamber 820.

The fuel injector valve 800 has an actuation liquid inlet 850 through which actuation liquid is received into the actuation chamber 812, thereby to act on the pump element 805 to pump the slurry fuel from the pump chamber 820 to the nozzle 808 in use. The fuel injector valve 800 also has an actuation liquid outlet 852 through which actuation liquid may be expelled from the fuel injector valve 800 as the volume of the actuation chamber 812 reduces on filling the pump chamber 820 with slurry fuel and movement of the pump element 805. The fuel injector valve 800 further has an actuation fluid conduit 854 that fluidly connects the actuation chamber 812 with a clearance between a longitudinal bore 832 and a valve needle 834 that sits within the longitudinal bore 832. The needle valve 834 is movable relative to the longitudinal bore 832 to control the flow of slurry fuel from the needle fuel chamber 144 and the nozzle 808 towards the combustion chamber of an engine in use.

The fuel supply valve 822 comprises a valve gate 875 that is moveable between a first position, at which the fuel inlet 802 is in fluid communication along a first slurry fuel flow path with the pump chamber port 806, and a second position, at which the fuel outlet 804 is in fluid communication along a second slurry fuel flow path with the pump chamber port 806. In this embodiment, the fuel supply valve 822 comprises a valve seat 803 at the fuel inlet 802, and the valve gate 875 is a valve head 875 for cooperation with the valve seat 803. However, in other embodiments, the fuel supply valve 822, and particularly the valve gate 875, could take a different form to that described here.

The valve gate 875 is mounted for movement relative to the valve seat 803 between the first position, as shown in FIG. 8, and the second position. In this embodiment, the movement is linear movement. In this embodiment, the movement is sliding movement. More specifically, the fuel supply valve 822 of this embodiment has a valve body 870 that comprises the valve gate 875 and is slidably movable in a valve bore 880 of the fuel supply valve 822. Moreover, in this embodiment, the valve body 870 is free to move in the valve bore 880. In some embodiments, the fuel supply valve 822 may therefore be considered a fluid-actuatable poppet valve. However, in other embodiments the fuel supply valve 822 may be other than a poppet valve, and/or the movement of the valve gate could be other than linear movement or other than sliding movement, such as a rotational movement or a combination of rotational and translational movement, for example a pivoting or camming movement.

In the first position, the valve gate 875 is spaced from the valve seat 803 to permit slurry fuel to flow from the fuel inlet 802 to the pump chamber port 806 and towards the pump chamber 820. On the other hand, in the second position, the valve gate 875 abuts against the valve seat 803 to hinder or prevent slurry fuel flowing from the fuel inlet 802 to the pump chamber port 806 and towards the pump chamber 820. That is, the fuel inlet 802 is, or is substantially, out of fluid communication with the pump chamber port 806 and the pump chamber 820, when the valve gate 875 is at the second position. The fuel supply valve 822 is thus for controlling the flow of slurry fuel into the fuel supply valve 822 and the fuel injector valve 800 as a whole.

In this embodiment, the pump chamber port 806 is in fluid communication with the fuel outlet 804 when the valve gate 875 is at the first position and when the valve gate 875 is at the second position. However, in other embodiments, a valve may be configured to selectively block the fuel outlet 804. For instance, the valve gate 875 may block the fuel outlet 804 when at the first position.

The valve gate 875 of the fuel supply valve 822 is fluid-actuatable. More specifically, the valve gate 875 is operable with a valve actuation liquid from an engine. The engine may be that into which the fuel injector valve 800 is to be installed to inject slurry fuel into a combustion chamber thereof. In particular, the fuel supply valve 822 comprises a valve actuation liquid chamber 872, into which valve actuation liquid is receivable to exert a force on the valve gate 875 to drive the valve gate 875 between the first position and the second position. More specifically, the valve actuation chamber 872 is on an opposite side of the valve gate 875 from the valve seat 803. Accordingly, feeding the valve actuation liquid into the valve actuation chamber 872 causes movement of the valve gate 875 towards the second position. The valve actuation liquid may be an oil, such as servo oil.

In this embodiment, the valve actuation liquid chamber 872 is isolated from the pump chamber port 806. More specifically, the valve gate 875 itself blocks a flow path between the valve actuation liquid chamber 872 and the pump chamber port 806. This helps avoid the slurry fuel being contaminated with the valve actuation liquid, and helps avoid the slurry fuel contaminating the valve actuation liquid and degrading the fuel supply valve 822.

In this embodiment, the valve body 870 has one or more grooves 871 therein for receiving the valve actuation liquid between the valve body 870 and the valve bore 880 to lubricate movement of the valve body 870 in the valve bore 880 and to further help seal the slurry fuel from the valve actuation liquid. The groove(s) 871 are in fluid communication with the valve actuation chamber 872, so that the valve actuation liquid is able to flow into the groove(s) 871 from the valve actuation chamber 872. The one or more grooves 871 may be circumferential grooves that extend fully around a circumference of the valve body 870.

The fuel supply valve 822 comprises a control valve 892 for controlling input of valve actuation liquid into the valve actuation chamber 872. More specifically, the fuel supply valve 822 comprises a valve actuation liquid conduit 890 via which valve actuation liquid is flowable into and out of the valve actuation chamber 872, and the control valve 892 is for controlling flow of valve actuation liquid through the valve actuation liquid conduit 890. In other embodiments, the valve actuation liquid may be flowable out of the valve actuation chamber 872 by a route other than the valve actuation liquid conduit 890, which may be controlled by the control valve 892 or another valve.

The control valve 892 has a first port for fluid communication with the valve actuation liquid chamber 872, a second port for fluid communication with a source 894 of valve actuation liquid, and a third port for fluid communication with a drain 896, and the control valve 892 is for selecting which of the second and third ports is in fluid communication with the first port. The source 894 of valve actuation liquid may be a servo oil system of an engine, such as that into which the fuel injector valve 800 is to be installed. In other embodiments, the control valve 892 could have a different number of ports. For example, in some embodiments, there may be a combined source 894 and drain 896, so that the third port could be omitted.

In this embodiment, the control valve 892 is electrically or electronically controllable, such as by an engine control unit (ECU). However, in other embodiments, other forms of control may be employed.

Figure 10:
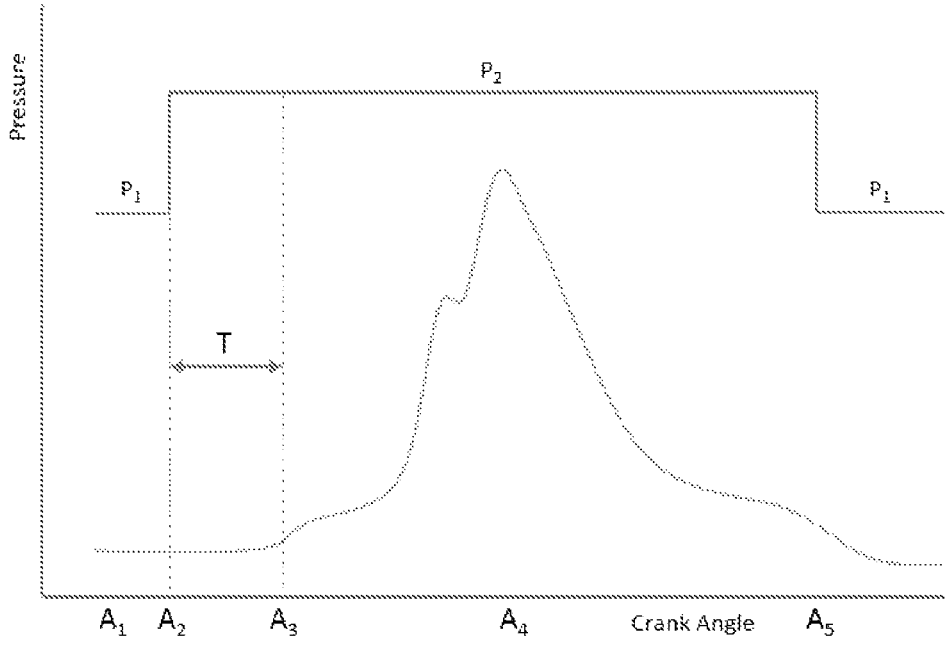
FIG. 10 shows a graph of slurry fuel pressure versus engine crank angle.

Operation of the fuel supply valve 822 of FIG. 8 will now be described with reference to FIG. 10, which shows a graph of pressure of the slurry fuel in the pump chamber 820 versus a crank angle of an engine (in which the fuel injector valve 800 is installed in use) during one engine cycle. FIG. 10 also shows the position of the valve gate 875 at different times during the engine cycle. In this embodiment, the control valve 892 is controlled in dependence on the crank angle of the engine, so as to ensure that the valve gate 875 is suitably positioned at different times in the engine cycle.

With the valve gate 875 in the first position as illustrated in FIG. 8, and the engine having a crank angle $A_1$ as illustrated in FIG. 10, slurry fuel flows through the fuel supply valve 822 from the fuel inlet 802 to the pump chamber port 806 and towards the pump chamber 820. The pressure of the slurry fuel, albeit relatively low, is sufficient to push the fuel pump piston 801 to expand the pump chamber 820. The pressure of the slurry fuel may, for example, be less than 30 bar or optionally between 20 and 30 bar. As the pump piston 801 and the actuation piston 807 are so pushed, a portion of the actuation liquid in the actuation chamber 812 flows out of the fuel injector valve 800 through the actuation liquid outlet 852.

When the pump chamber 820 has filled with the slurry fuel, valve actuation liquid is driven into the valve actuation chamber 872 via the valve actuation liquid conduit 890 under the control of the control valve 892. This drives the valve gate 875 from the first position ($P_1$ in FIG. 10) to the second position ($P_2$ in FIG. 10), so as to close the fuel inlet 802 at a crank angle $A_2$ of the engine. The valve actuation liquid in the valve actuation chamber 872 is preferably at higher pressure than the slurry fuel in the fuel inlet 802. For example, the valve actuation liquid may be at a pressure of over 100 bar, such as between 180 and 200 bar.

Once the valve gate 875 is at the second position, high pressure actuation liquid is caused (such as by the engine control unit) to rapidly flow into the actuation chamber 812 via the actuation liquid inlet 850. Since the actuation liquid is at a much greater pressure than the slurry fuel in the pump chamber 820, the actuation liquid exerts a force on the pump element 805 to cause the slurry fuel in the pump chamber 820 to be pressurised, as shown in the graph of FIG. 10, and forced into the needle fuel chamber 844 via the nozzle fuel conduit 824. This causes the moveable valve needle 834 to move to an open position to permit the slurry fuel to be pushed out of the fuel injector valve 800 and towards the engine combustion chamber. At the same time, a portion of the actuation liquid is driven along the actuation fluid conduit 854 to the clearance between the longitudinal bore 832 and the valve needle 834 located therein, so as to help dislodge or flush carbonaceous or other hard-wearing particles that might have accumulated in the clearance.

Since the valve gate 875 is at the second position during this actuation of the injector, slurry fuel is unable to be forced also into the fuel inlet 802 from the pump chamber 820. To better ensure this, there may be a predetermined delay (shown as T in FIG. 10), such as at least 50 ms or at least 100 ms, between the valve gate 875 reaching the second position at crank angle $A_2$ of the engine and the high pressure actuation liquid being caused to rapidly flow into the actuation chamber 812 at a subsequent crank angle $A_3$ of the engine.

The timing of this actuation of the injector 800 may be such that the slurry fuel in the pump chamber 820 experiences a peak pressure when the piston in the engine combustion chamber is approximately at top dead centre (TDC) (crank angle $A_4$ of the engine, in FIG. 10). However, in some embodiments, there may be a small timing offset between TDC and the peak pressure. The injection of the slurry fuel into the combustion chamber may lead or lag TDC. In some embodiments, the timing offset is selectable or modifiable, such as by the engine control unit or by an operator suitably operating the engine control unit.

Thereafter, the flow of high pressure actuation liquid into the actuation chamber 812 is caused to cease (such as by the engine control unit), and as a result the needle valve 834 moves to a closed position under the biasing force of a spring 842, as previously described with reference to other embodiments, to prevent or hinder the flow of slurry fuel from the needle fuel chamber 844 out of the fuel injector valve 800.

Moreover, the flow of valve actuation liquid into the valve actuation chamber 872 is caused to cease through operation of the control valve 892, such as by the engine control unit. The relatively low pressure of the slurry fuel in the fuel inlet 802 is then sufficient to drive the valve gate 875 from the second position to the first position at a crank angle $A_5$ of the engine, so as to open the fuel inlet 802 and begin cycle again. During this movement of the valve gate 875, at least a portion of the valve actuation liquid is expelled from the valve actuation chamber 872 to the drain 896 via the valve actuation liquid conduit 890 and the control valve 892. As such, the slurry fuel does not experience significant resistance to the valve gate 875 moving to the first portion. The drain 896 may return the valve actuation liquid back to the source 894 of valve actuation liquid.

In this embodiment, there is no spring or other biasing device to urge the valve gate 875 towards the first position. However, such a biasing device may be present in other embodiments.

It will be appreciated that, in contrast to the fluid-actuatable fuel supply valve 122 of FIGS. 6*a* to 6*c*, it is not the slurry fuel that is used to drive the valve gate 875 from the first position to the second position but another fluid. By avoiding the slurry fuel having to work against the valve gate 875 to move the valve gate 875 from the first position to the second position, the pressure of the slurry fuel can be relatively low. This in turn helps to avoid agglomeration of solid particles from the slurry fuel in and near the fuel supply valve.

Moreover, in some embodiments, during movement of the valve gate 875 from the first position to the second position, the valve gate 875 does not substantially exert a force opposing the flow of the slurry fuel from the fuel inlet 802. As described previously in relation to another embodiment, this means that the slurry fuel can be maintained at a relative low pressure, and so the chances of the non-Newtonian slurry fuel precipitating out or the solid fuel particles agglomerating are lessened. However, in other embodiments, during movement of the valve gate 875 from the first position to the second position, the valve gate 875 does exert a force opposing the flow of the slurry fuel from the fuel inlet 802.

In another embodiment two or more of the above described embodiments are combined. Features of one embodiment can be combined with features of other embodiments.

Embodiments of the present invention have been discussed with particular reference to the examples illustrated.

However it will be appreciated that variations and modifications may be made to the examples described within the scope of the invention.

What is claimed is:

1. A fuel supply valve for a slurry fuel injector valve, the fuel supply valve comprising:

a fuel inlet for fluid communication with a slurry fuel reservoir;

a fuel outlet for fluid communication with a nozzle of the fuel injector valve;

a pump chamber port for fluid communication with a pump chamber of the fuel injector valve;

a valve gate moveable between a first position, at which the fuel inlet is in fluid communication along a first slurry fuel flow path with the pump chamber port, and a second position, at which the fuel outlet is in fluid communication along a second slurry fuel flow path with the pump chamber port; and a valve actuation liquid chamber;

wherein the valve gate is operable with a valve actuation liquid from an engine;

wherein the valve actuation liquid is receivable into the valve actuation liquid chamber to exert a force on the valve gate to drive the valve gate between the first and second positions; and wherein the valve gate blocks a flow path between the valve actuation liquid chamber and the pump chamber port so that the valve actuation liquid chamber is isolated from the pump chamber port.

2. The fuel supply valve according to claim 1, wherein valve actuation liquid is receivable into the valve actuation liquid chamber to exert a force on the valve gate to drive the valve gate towards the second position.

3. The fuel supply valve according to claim 1, comprising a valve body and a valve bore, wherein the valve body includes the valve gate and is movable in the valve bore, and wherein the valve body has at least one groove therein for receiving the valve actuation liquid between the valve body and the valve bore to lubricate movement of the valve body in the valve bore.

4. The fuel supply valve according to claim 1, comprising a control valve for controlling input of valve actuation liquid into the valve actuation liquid chamber.

5. The fuel supply valve according to claim 4, wherein the control valve is electrically or electronically controllable.

6. The fuel supply valve according to claim 4, wherein the control valve has a first port for fluid communication with the valve actuation liquid chamber, a second port for fluid communication with a source of valve actuation liquid, and a third port for fluid communication with a drain, and wherein the control valve is for selecting which of the second and third ports is in fluid communication with the first port.

7. The fuel supply valve according to claim 1, wherein the valve gate is linearly moveable between the first and second positions.

8. The fuel supply valve according to claim 1, wherein the valve gate permits slurry fuel to flow from the fuel inlet to the pump chamber port when the valve gate is at the first position, and wherein the valve gate hinders or prevents slurry fuel flowing from the fuel inlet to the pump chamber port when the valve gate is at the second position.

9. The fuel supply valve according to claim 1, wherein the pump chamber port is in fluid communication with the fuel outlet when the valve gate is at the first position and when the valve gate is at the second position.

10. A fuel injector valve for a slurry fuel, the fuel injector valve comprising:

a nozzle via which slurry fuel is able to exit the injector valve towards a combustion chamber of an engine;

a housing and a pump cavity within the housing;

a pump element that divides the pump cavity into a pump chamber and an actuation chamber; and a fuel supply valve according to claim 1 for selectively placing the pump chamber in fluid communication with the fuel inlet of the fuel supply valve.

11. The fuel injector valve according to claim 10, wherein the pump element is fluid-actuatable.

12. A fuel injector valve according to claim 10, wherein the pump element comprises a shuttle piston.

13. A fuel injector valve according to claim 12, wherein the shuttle piston comprises:

a pump piston slidably mounted in the pump chamber and arranged to exert a force on the slurry fuel; and an actuation piston coupled to the pump piston and arranged to transmit a force to the pump piston.

14. A fuel supply valve for a slurry fuel injector valve, the fuel supply valve comprising:

a fuel inlet for fluid communication with a slurry fuel reservoir;

a fuel outlet for fluid communication with a nozzle of the fuel injector valve;

a pump chamber port for fluid communication with a pump chamber of the fuel injector valve; and wherein the fuel supply valve is for selectively coupling the pump chamber port with the fuel outlet or the fuel inlet by the fuel supply valve comprising a valve gate moveable in a valve chamber between a first position, wherein the fuel inlet is in fluid communication along a first slurry fuel flow path with the pump chamber port, and a second position, wherein the fuel outlet is in fluid communication along a second slurry fuel flow path with the pump chamber port;

wherein the valve gate is arranged to not substantially exert a force opposing a flow of the slurry fuel into the valve chamber when the valve gate moves between the second position and the first position and/or between the first position and the second position.

* * * * *